US007605778B2

(12) United States Patent
Akiba

(10) Patent No.: US 7,605,778 B2
(45) Date of Patent: Oct. 20, 2009

(54) PLASMA DISPLAY PANEL AND DISPLAY EMPLOYING THE SAME HAVING TRANSPARENT INTERMEDIATE ELECTRODES AND METAL BARRIER RIBS

(75) Inventor: Yutaka Akiba, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 126 days.

(21) Appl. No.: 10/316,093

(22) Filed: Dec. 11, 2002

(65) Prior Publication Data

US 2003/0132898 A1 Jul. 17, 2003

(30) Foreign Application Priority Data

Dec. 14, 2001 (JP) ..... 2001-382395

(51) Int. Cl.
*G09G 3/28* (2006.01)

(52) U.S. Cl. ..... 345/60

(58) Field of Classification Search ..... 345/60–72; 313/582–587; 315/169.4
See application file for complete search history.

(56) References Cited

U.S. PATENT DOCUMENTS

| | | | | |
|---|---|---|---|---|
| 4,461,978 | A | 7/1984 | Mikoshiba et al. | |
| 6,002,382 | A * | 12/1999 | Hayashi et al. | 345/60 |
| 6,002,456 | A * | 12/1999 | Togawa | 349/32 |
| 6,262,532 | B1 | 7/2001 | Park et al. | |
| 6,414,656 | B1 * | 7/2002 | Hong | 345/60 |
| 6,508,685 | B1 * | 1/2003 | Lee et al. | 445/24 |
| 6,538,381 | B1 | 3/2003 | Ueoka et al. | |
| 6,614,411 | B2 * | 9/2003 | Hayashi | 345/60 |
| 6,717,557 | B2 * | 4/2004 | Ishizuka | 345/60 |
| 2001/0030632 | A1 | 10/2001 | Shiokawa et al. | |

FOREIGN PATENT DOCUMENTS

| | | |
|---|---|---|
| EP | 1156506 | 11/2001 |
| JP | 05-333813 | 12/1993 |
| JP | 06-260092 | 9/1994 |
| JP | 08-315735 | 11/1996 |
| JP | 10/207419 | 8/1998 |
| JP | 10-207419 | 8/1998 |
| JP | 11-120919 | 4/1999 |
| JP | 11-312470 | 11/1999 |
| JP | 2000-048715 | 2/2000 |
| JP | 2000-306516 | 11/2000 |
| JP | 2000306516 A * | 11/2000 |
| JP | 2001-084913 | 3/2001 |
| JP | 2001-143621 | 5/2001 |

* cited by examiner

*Primary Examiner*—Sumati Lefkowitz
*Assistant Examiner*—Rodney Amadiz
(74) *Attorney, Agent, or Firm*—Mattingly & Malur, P.C.

(57) ABSTRACT

An intermediate electrode is formed in a space between an X display electrode and a Y display electrode parallel thereto. A negative voltage is applied to the Y display electrode to use the Y display electrode as a cathode. A charge is stored between the Y display electrode and an intermediate electrode to create an electric field. Upon the increase of the intensity of the electric field to a sufficiently high level, an instant discharge occurs between the Y display electrode and the X display electrode and intense ultraviolet rays are produced. The fluorescent layer excited by the ultraviolet rays emits visible light. Only a narrow pulse current flows through the X display electrode and the Y display electrode, so that power consumption can be suppressed at high emission efficiency.

25 Claims, 13 Drawing Sheets

PLASMA DISPLAY PANEL AND DISPLAY EMPLOYING THE SAME HAVING TRANSPARENT INTERMEDIATE ELECTRODES AND METAL BARRIER RIBS

BACKGROUND OF THE INVENTION

1. Field of the Invention

The present invention relates to a plasma display panel for a use in information processing terminals and flat wall television sets, and a display employing the same. In particular, the present invention relates to a plasma display panel capable of operating at greatly improved luminous efficiency and of displaying images in greatly improved luminance, and to a display employing the same.

2. Description of the Related Art

A reflective three-electrode surface discharge plasma display panel provided with two kinds of transparent display electrodes formed on the same surface of a front substrate is used prevalently. A prior art reflective three-electrode surface discharge plasma display panel is disclosed in JP 10-207419A.

Referring to FIG. 12 showing part of the known plasma display in a perspective view, there are shown a front substrate FS, a back substrate BS, a front glass substrate 1, an X display electrode 2, a transparent X display electrode 2*a*, an X bus electrode 2*b*, a Y display electrode 3, a transparent Y display electrode 3*a*, a Y bus electrode 3*b*, a protective film 4, a dielectric layer 5, a back glass substrate 6, address electrodes 7, a dielectric layer 8, barrier ribs 9, fluorescent layers 10R, 10G and 10B, and discharge spaces 11. The X display electrode 5 and the Y display electrode 6 will be referred to inclusively as display electrodes.

As shown in FIG. 12, in the back substrate BS, the plurality of address electrodes 7 are arranged in parallel on the back glass substrate 6. The dielectric layer 8 covers the address electrodes 7 entirely. The barrier ribs 9 are formed parallel with the address electrodes 7 in parts corresponding to the address electrodes 7 on the dielectric layer 8 so as to define elongate spaces parallel to the address electrodes 7. The fluorescent layers that emit color light when irradiated with ultraviolet rays are formed on the side surfaces of the barrier ribs 9 and the surface of the dielectric layer 8. The fluorescent layers 10R formed in every two other discharge spaces 11 emit red light, the fluorescent layers 10G formed in every two other discharge spaces 11 emit green light, and the fluorescent layers 10B formed in every two other discharge spaces 11 emit blue light.

In the front substrate FS, the X display electrodes 2 and the Y display electrodes 3 are formed alternately in parallel on the front glass substrate 1 so as to extend in a direction perpendicular to the address electrodes 7 formed on the back glass substrate 6. Each of the X display electrodes 2 has the transparent X display electrode 2*a* and the X bus electrode 2*b* formed on the transparent X display electrode 2*a*. Each of the Y display electrodes 3 has the transparent Y display electrode 3*a* and the Y bus electrode 3*b* formed on the transparent Y display electrode 3*a*. The X display electrode 2 and the Y display electrode 3 adjacent to the X display electrode 2 form one display electrode pair. In the display electrode pair, the X bus electrode 2*b* is formed on the transparent X display electrode 2*a* along an edge remote from the transparent Y display electrode 3*a* of the transparent X display electrode 2*a*, and the Y bus electrode 3*b* is formed on the transparent Y display electrode 3*a* along an edge remote from the transparent X display electrode 2*a* of the transparent Y display electrode 3*a*. The dielectric layer 5 covers the X display electrodes 2 and the Y display electrodes 3 entirely. The protective film 4 of MgO or the like is formed on the dielectric layer 5.

A plasma display panel is constructed by setting the back glass substrate 6 and the front glass substrate 1 provided with those electrodes opposite to each other and joining the same together as indicated by the arrows with the protective film 4 of the front glass substrate 1 in contact with the barrier ribs 9.

A specific gas is sealed in the discharge spaces 11 defined by the protective film 4, the barrier ribs 9 having surfaces coated with the fluorescent layers 10R, 10G and 10B, and the dielectric layer 8. The X bus electrode 2*b* and the Y bus electrode 3*b* of each display electrode pair and the two adjacent barrier ribs 9 define a space that serves as a discharge cell in the discharge space 11.

FIG. 13 shows the arrangement of the electrodes of the plasma display panel shown in FIG. 12. In FIG. 13, A1, A2, . . . and An (n≧1) indicate the address electrodes 7 shown in FIG. 12, X1, X2, . . . and Xm (m>1) indicate the X display electrodes 2, and Y1, Y2, . . . and Ym indicate the Y display electrodes 3.

Referring to FIG. 13, the m X display electrodes X1, X2, . . . and Xm and the m Y display electrodes Y1, Y2, . . . and Ym are arranged alternately parallel with each other. Ends of the X display electrodes X1, X2, . . . and Xm are connected together to apply the same driving voltage to the X display electrodes X1, X2, . . . and Xm. Thus, the X display electrodes 2 are referred to as common display electrodes. Driving voltages respectively having different waveforms are applied respectively to the Y display electrodes Y1, Y2, . . . and Ym. The address electrodes A1, A2, . . . and An are independent, and the X display electrodes X1, X2, . . . and Xm and the Y display electrodes Y1, Y2, . . . and Ym are perpendicular to each other, and driving voltages of different waveforms are applied to those electrodes.

FIG. 14 illustrates an addressing method of driving such an AC type plasma display panel. This addressing method drives subfields individually.

One field period F is divided into, for example, eight subfields SF1 to SF8. A period corresponding to the difference between total time corresponding to the eight subfields and the period of one cycle of a vertical synchronizing signal $V_{sync}$ is a blank period $T_B$. As shown in FIG. 15, each of the subfields SFn (n=1, 2, . . . and 8) consists of a priming and erase discharge period $T_W$, an address discharge period $T_A$ and a discharge sustaining period $T_S$.

The priming and erase discharge period $T_W$ and the address discharge period $T_A$ must be the same in all the subfields SFn. For example, the address discharge period $T_A$ is dependent on the number m of the Y display electrodes (FIG. 13) and the period of scan pulses applied sequentially to the Y display electrodes 3. The discharge sustaining period $T_S$ is dependent on the period and number of a stream of discharge sustaining pulses. In the priming and erase discharge period $T_W$, a discharge occurs between the X display electrode 2 and the Y display electrode 3 to produce a wall charge by producing charged particles. In the address discharge period $T_A$, a discharge occurs between the Y display electrodes 3 and the address electrodes 7 for the cells in which a sustained discharge must be generated (discharge cells) for the discharge sustaining period $T_S$, to select discharge cells in which a discharge is sustained for the discharge sustaining period $T_S$. A discharge is repeated in the selected discharge cells by the number of times corresponding to the number of discharge sustaining pulses applied in the discharge sustaining period $T_S$ in the subfields. As shown in FIG. 14, the one field F has eight subfields SF, and the number of discharge sustaining pulses in the discharge sustaining period $T_S$ of the subfields SF1, SF2, . . . and SF8 is weighted by a weight expressed by a binary code.

Suppose that the numbers of discharge sustaining pulses, i.e., discharge sustaining cycles, in the discharge sustaining period $T_S$ of the subfields SF1, SF2, . . . and SF8 are $N_{SF1}$ to $N_{SF8}$. Then, the ratio between the discharge sustaining cycles is equal to the weighting ratio expressed by binary codes: $N_{SF1}$: $N_{SF2}$: . . . :$N_{SF8}$=1:2:4:8: . . . :128. Thus, pictures can be displayed in 256 gradations by using the subfields in which a sustained discharge occurs in the discharge sustaining period $T_S$ in combination. For example, when the 10th gradation from a low luminance excluding the gradation zero is displayed, the subfields SF2 and SF4 corresponding to the relative ratios 2 and 8 between the numbers of discharge sustaining pulses are selected by an address discharge in the address discharge period $T_A$, and a discharge is sustained for the discharge sustaining periods $T_S$.

This prior art plasma display panel does not have any internal ground electrode (earth electrode) or is not provided with any ground electrode. Therefore, the plasma display panel cannot be satisfactorily grounded, discharges in the panel are unstable, and undesired electromagnetic radiation that affects adversely to the nearby drive circuit occurs.

In the plasma display panel shown in FIG. 12, a glow discharge (plasma) is generated between the display electrodes, i.e., the X display electrodes 2 and the Y display electrodes 3, the fluorescent films 10R, 10G and 10B are excited by ultraviolet rays produced by the glow discharge to make the fluorescent layers 10R, 10G and 10B emit visible light. However, if the distances between the display electrodes 2 and 3 are not sufficiently long, the discharge mode of glow discharge has difficulty in forming a positive column region that produces ultraviolet rays effectively, and most part of the glow discharge is a negative glow region. The discharge sustaining current must be reduced in the discharge sustaining period $T_S$ to produce positive columns efficiently. Since the barrier ridges 9 shown in FIG. 12 are dielectric, charged particles produced by a discharge diffuse into the barrier ribs 9, causing loss that reduces luminous efficiency. The current needs to be increased to sustain a discharge, which reduces the efficiency of positive columns.

A plasma display panel disclosed in JP 11-312470A employs a metal barrier ribs formed of a conductive metal to solve such problems. FIG. 16 is a longitudinal sectional view of this prior art plasma display panel, in which parts like or corresponding to those shown in FIG. 12 are denoted by the same reference characters. Shown in FIG. 16 are fluorescent layers 10, base films 12 and 13, a dielectric layer 14, a protective layer 15 of MgO or such, metal barrier ribs 16 and oxide films 17.

As shown in FIG. 16, Y display electrodes 3 are formed on a back substrate BS. The back substrate BS has a back glass substrate 6, a base layer 13 of $SiO_2$ formed on the back glass substrate 6, address electrodes 7 of a thick conductive film of an Ag-bearing material formed on the base layer 13, a dielectric layer 8 covering the address electrodes 7, Y display electrodes 3 of a thick conductive film of an AG-bearing material formed on the dielectric layer 8, a dielectric layer 14 covering the Y display electrodes 3, and the protective layer 15 of MgO or such. The front substrate FS has a front glass substrate 1, a base layer 12 of $SiO_2$ formed on the front glass substrate 1, X display electrodes 2 each consisting of a transparent X display electrode 2*a* of an Ag-bearing material and an opaque X bus electrode 2*b* of an Ag-bearing material formed on the base layer 12, a dielectric layer 5 covering the X display electrodes 2, and a protective layer 4 of MgO formed on the dielectric layer 5.

Metal barrier ribs 16 are sandwiched between the front substrate FS and the back substrate BS so as to define discharge spaces 11. The metal barrier ribs 16 are formed by making through holes corresponding to the discharge spaces 11 for cells in a thin plate of an Fe—Ni alloy having a coefficient of thermal expansion substantially equal to those of the glass substrates 1 and 6 by an etching process. FIG. 17 is a sectional view taken on line Z-Z in FIG. 16. As shown in FIG. 17, the discharge spaces 11 of the cells are surrounded by the metal barrier ribs 16. The metal barrier ribs 16 are covered entirely with an insulating oxide film 17. Surfaces of the metal barrier ribs 16 defining the discharge spaces 11, i.e., the inner surfaces of the through holes provided in the thin plate, are coated with fluorescent layers 10.

When a fixed bias voltage is applied to the metal barrier ribs 16 of this plasma display panel, wall charges are accumulated in the dielectric layer (oxide film 17) covering the metal barrier ribs 16 or in the fluorescent layers 10, whereby the neutralization of the charged particles is controlled, energy loss due to diffusion into the barrier ribs can be reduced, stable positive columns are formed, and discharge efficiency and luminous efficiency are improved.

The prior art plasma display panel is able to form stable positive columns by reducing discharge sustaining current to improve discharge efficiency. However, the low driving current reduces luminance for one pulse. Thus, the plasma display panel is required to achieve both high emission efficiency and high luminous efficiency.

SUMMARY OF THE INVENTION

The present invention has been made in view of those problems in the prior art and it is therefore an object of the present invention to provide a plasma display panel capable of operating at a high emission efficiency and displaying pictures in high luminance, and a display employing the plasma display panel.

According to a first aspect of the present invention, a plasma display panel comprises: a front substrate provided with parallel first and second display electrodes for each of cells, and transparent intermediate electrodes each formed in a space between the first and the second display electrode; a back substrate provided with address electrodes extended across the first and the second electrodes; metal barrier ribs disposed between the front and the back substrate and defining discharge spaces for the cells; and fluorescent layers formed in the discharge spaces; wherein each of the intermediate electrodes is disposed relative to the first and the second display electrode so that a narrow pulse discharge occurs between the first and the second display electrode.

The plasma display panel in the first aspect of the present invention may further comprise means that drives the first and the second electrode by alternate anode drive and cathode drive for a narrow pulse discharge such that the first or the second display electrode is driven by anode drive while the other display electrode is driven by cathode drive, and drives the intermediate electrodes always by anode drive.

The plasma display panel in the first aspect of the present invention may further comprise means that makes the intermediate electrode approach the first and the second electrode.

The means may include projections projecting from the first and the second display electrode toward the intermediate electrode or projections projecting from the opposite sides of the intermediate electrode toward the first and the second electrode.

According to a second aspect of the present invention, a plasma display panel comprises: a front substrate provided with parallel first and second display electrodes for each of cells, and transparent intermediate electrodes each formed in a space between the first and the second display electrode; a back substrate provided with address electrodes extended across the first and the second electrodes; metal barrier ribs disposed between the front and the back substrate and defining discharge spaces for the cells; and fluorescent layers formed in the discharge spaces; wherein the metal barrier ribs are disposed relative to the first and the second display electrodes so that a narrow pulse discharge occurs between the first and the second electrode.

In the plasma display panel in the second aspect of the present invention, the metal barrier ribs may be disposed close to the first and the second display electrode at a predetermined distance necessary for generating a narrow pulse discharge between the first and the second display electrode.

The plasma display panel according to the present invention may further comprise stabilizing means that stabilizes the intermediate electrodes at a predetermined potential, and the stabilizing means may include projections formed in parts intersecting the intermediate electrodes of the metal barrier ribs or may include a conductive layer formed between the intermediate electrodes and the metal barrier ribs in parts where the intermediate electrodes intersect the metal barrier ribs of the front substrate.

The conductive layer may be disposed in projections formed in the intermediate electrodes or a dielectric layer formed on a surface facing the back substrate of the front substrate.

DESCRIPTION OF THE PREFERRED EMBODIMENTS

Preferred embodiments of the present invention will be described with reference to the accompanying drawings.

Figure 1A:
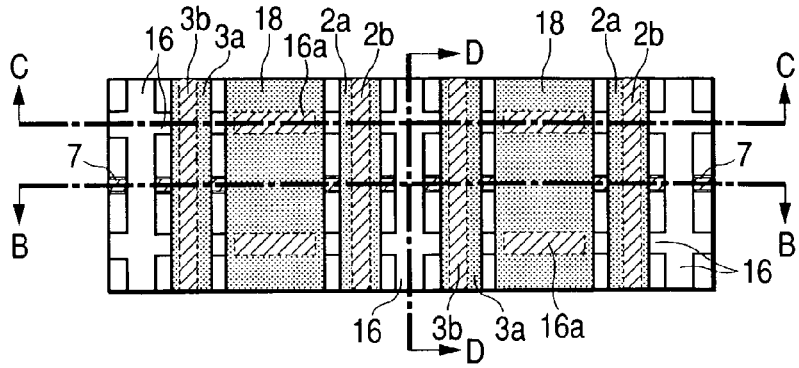
FIGS. 1A to 1D are views of a plasma display panel in a first embodiment according to the present invention.
Figure 1B:
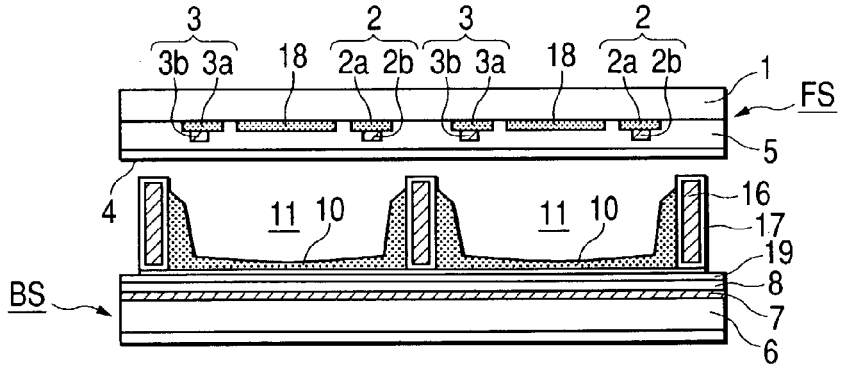
Figure 1C:
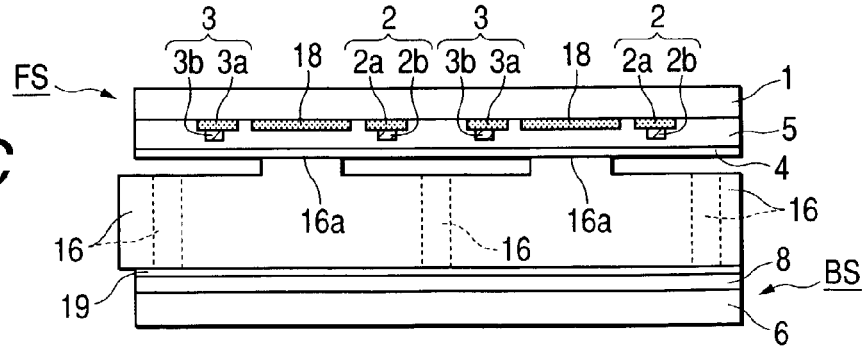
Figure 1D:
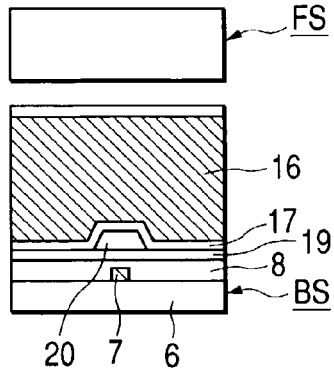
Figure 12:
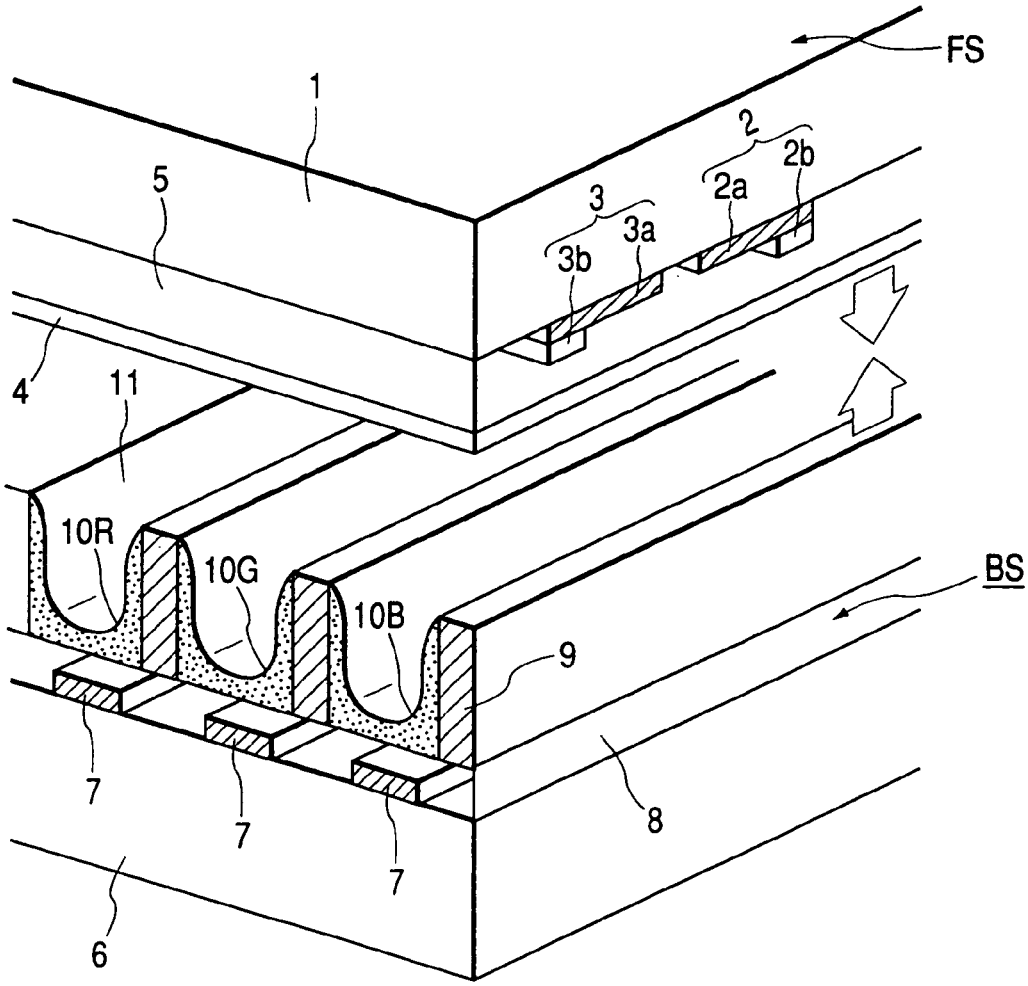
FIG. 12 PRIOR ART
FIG. 12 is a fragmentary perspective view of a prior art plasma display panel.
Figure 13:
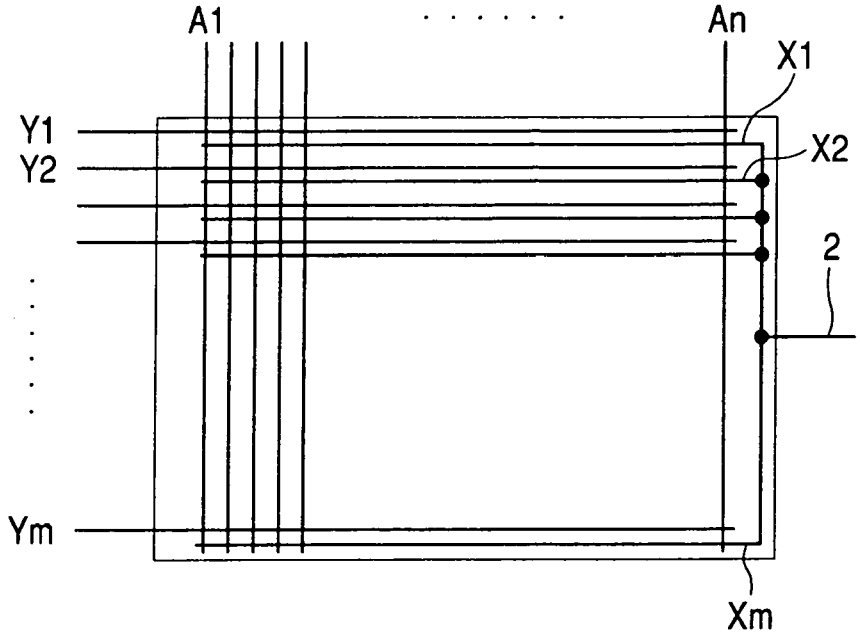
FIG. 13 PRIOR ART
FIG. 13 is a schematic plan view of electrodes of the plasma display panel shown in FIG. 12.
Figure 16:
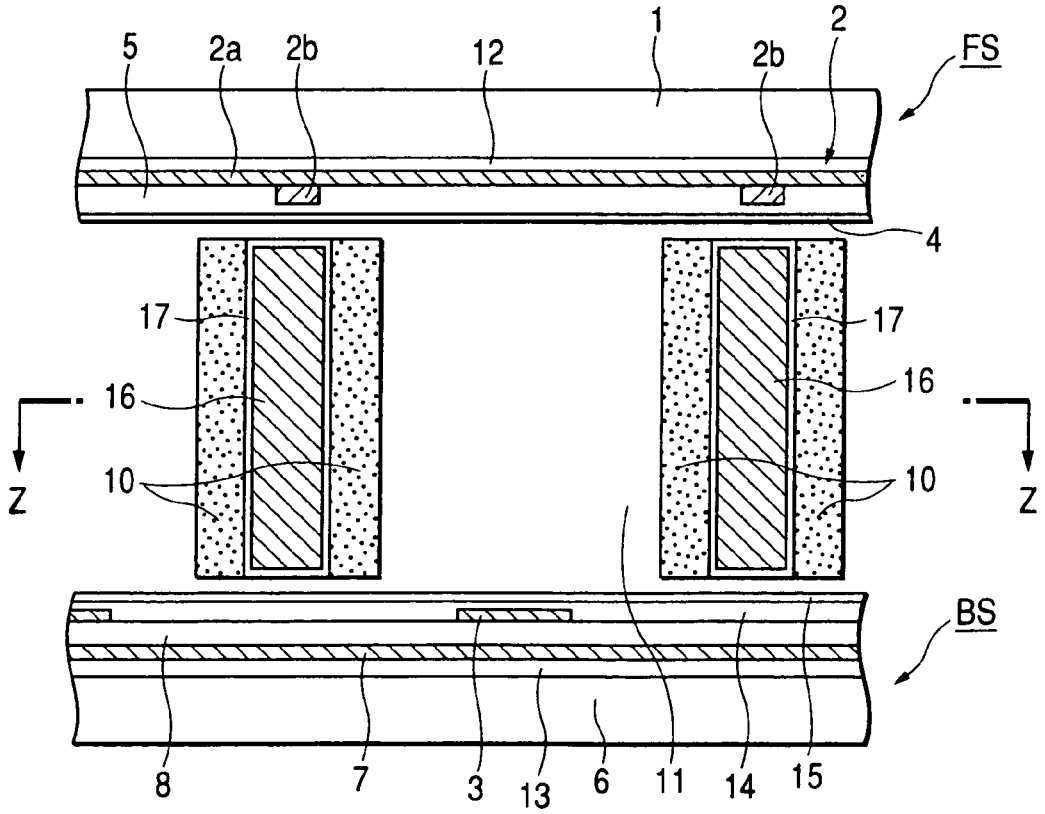
FIG. 16 PRIOR ART
FIG. 16 is a longitudinal sectional view of one cell of a plasma display panel provided with metal barrier ribs.
Figure 17:
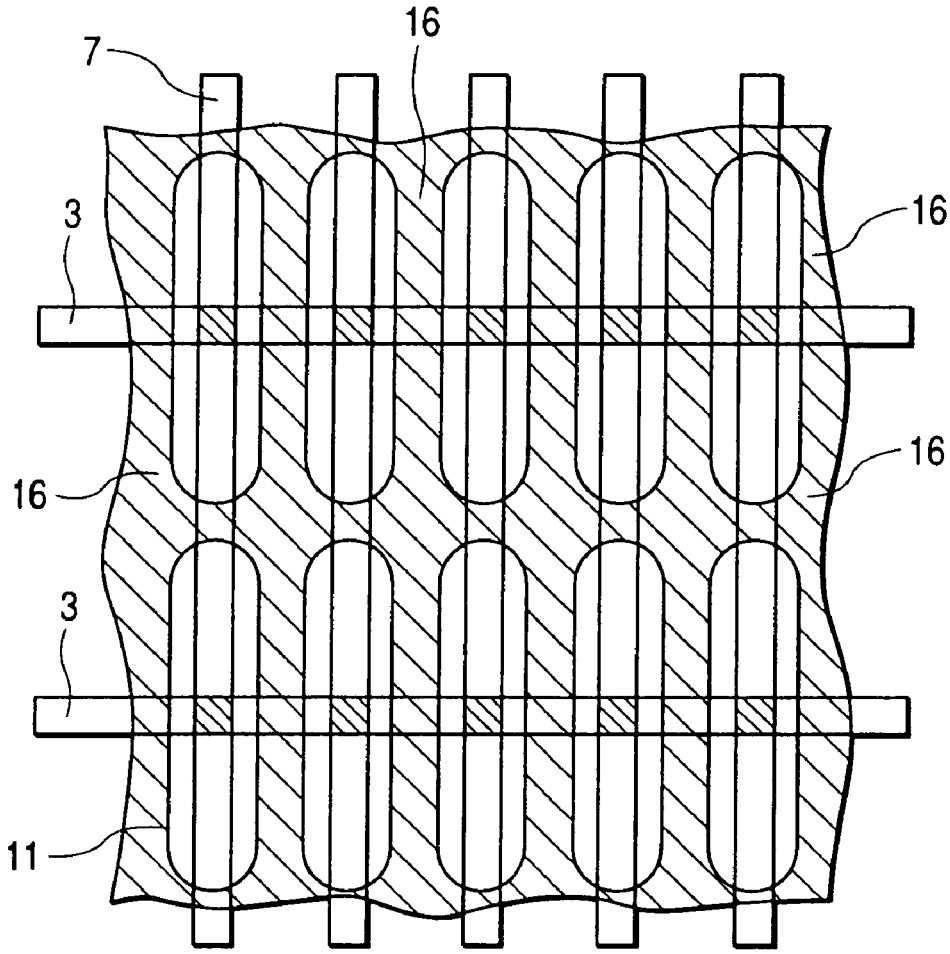
FIG. 17 PRIOR ART
FIG. 17 is a sectional view taken on line Z-Z in FIG. 16.

FIG. 1A is a plan view of plasma display panel in a first embodiment according to the present invention as viewed from the side of a front panel. FIGS. 1B, 1C and 1D are sectional views taken on line B-B, line C-C and line D-D, respectively, in FIG. 1A. Shown in FIGS. 1A to 1D are metal barrier ribs 16, projections 16*a* projecting from the metal barrier ribs 16, intermediate electrodes 18, a protective layer 19 of an MgO film or such, and a hollow 20. In FIGS. 1A to 1D, parts like or corresponding to those shown in FIGS. 12 and 16 are denoted by the same reference characters and the description thereof will be omitted to avoid duplication.

Referring to FIG. 1, the metal barrier ribs 16 are formed by making through holes corresponding to discharge spaces 11 for cells in a thin plate of an Fe—Ni alloy having a coefficient of thermal expansion substantially equal to those of glass substrates 1 and 6 by an etching process or the like. As shown in FIG. 1B, all the surfaces of the metal barrier ribs 16 are coated entirely with an insulating film 17 of an oxide. As obvious from FIG. 1A, a discharge space 11 for each cell is surrounded by the metal barrier ribs 16. Thus, discharge spaces 11 are separated from each other by the metal barrier ribs 16.

As shown in FIG. 1A, the intermediate electrode 18 is extended in a space between an X display electrode 2 and a Y display electrode 3 (display electrodes) in parallel to the X display electrode 2 and the Y display electrode 3. The intermediate electrodes 18 are formed from a transparent film, such as an ITO film ($In_2O_3$:Sn film) to avoid reducing the aperture ratio of the cells. The intermediate electrodes 18 are disposed close to the X display electrodes 2 and the Y display electrodes 3. Intervals between the intermediate electrodes 18, and the X display electrodes 2 and the Y display electrodes 3 are in the range of about 50 to about 100 μm, preferably, in the range of about 70 to about 100 μm.

As shown in FIG. 1C, the projections 16*a* are formed in parts intersecting the electrodes 2, 3 and 18 of the metal barrier ribs 16 (parts on line C-C in FIG. 1A) opposite to the transparent intermediate electrodes 18 to reduce the distance between the metal barrier ribs 16 and the intermediate electrode 18. The driving potential of the intermediate electrode 18 (anode drive) is stabilized by disposing the parts intersecting the intermediate electrode 18 of the metal barrier rib 16 close to the intermediate electrode 18 in order that floating capacity between the intermediate electrode 18 and the metal barrier rib 16 is increased to enhance the capacitive coupling of the metal barrier rib 16 and the intermediate electrode 18. The distance between the metal barrier ribs 16 excluding the projections 16*a* and a protective film 4 formed on the front glass substrate 1 is, for example, in the range of about 20 to about 100 μm, preferably, in the range of about 50 to about 100 μm. The projections 16*a* have a height approximately equal to the distance.

The projections 16*a* are formed in a length somewhat shorter than the width of the intermediate electrodes 18 so that the projections 16*a* are separated from the display electrodes to avoid the influence of the projections 16*a* of the metal barrier ribs 16 on the gap length between the display electrodes 2 and 3, and the intermediate electrodes 18, i.e., discharge voltage, and to prevent the change of the capacitive coupling of the metal barrier ribs 16 and the display electrodes 2 and 3.

As shown in FIG. 1D, parts of a dielectric layer 8 formed on a back substrate BS are raised along address electrodes 7 to make the hollows 20 between the overlying protective layer 19 and the insulating film 17 coating the metal barrier ribs 16. The hollows 20 increase the distance between the address electrodes 7 and the metal barrier ribs 16 to a distance in the range of about 20 to about 100 μm, so that the capacitive coupling of the address electrodes 7 and the metal barrier ribs 16 is reduced.

The plasma display panel in the first embodiment is similar in other respects to those shown in FIGS. 12 and 16.

A driving operation of driving the plasma display panel in the first embodiment will be described with reference to FIG. 2.

The plasma display panel in the first embodiment emits light by a non-stationary discharge instead of by a stationary glow discharge using a negative glow region used by the foregoing prior art plasma display panel. A Townsend discharge is used instead of the conventional normal glow discharge to produce intense ultraviolet rays to attain high luminance and high luminous efficiency. The intermediate electrodes 18 or the metal barrier ribs 16 are disposed between the display electrodes 2 and 3, the electrodes are driven by anode drive to make effective short gaps between the corresponding display electrodes 2 and 3 to create high electric fields with a low voltage in the cells to generate a narrow pulse discharge in which a narrow pulse current flows.

Figure 15:
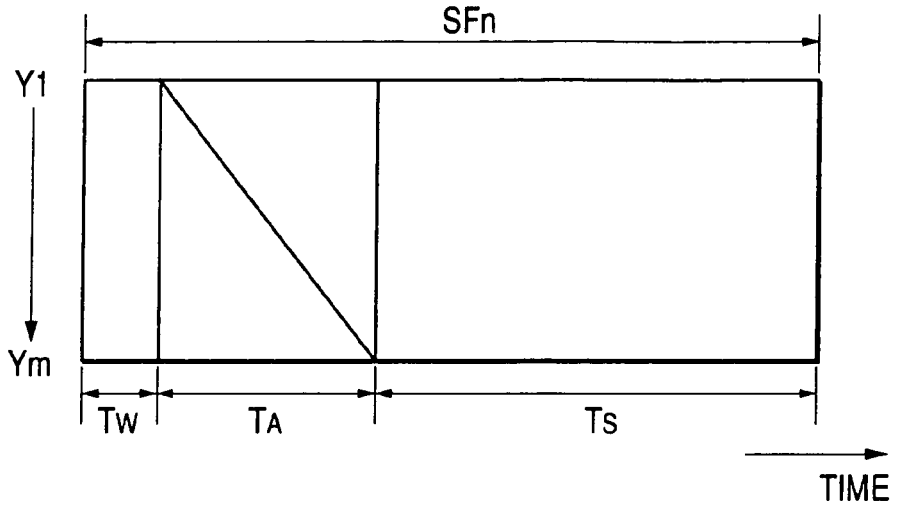
FIG. 15 PRIOR ART
FIG. 15 is a view showing a subfield shown in FIG. 14.

In the driving operation of the first embodiment, the electrodes including the metal barrier ribs 16 function as anodes and cathodes. A ground voltage (0 V) is applied to the anodes and a negative voltage is applied to the cathodes. The metal barrier ribs 16 and the intermediate electrodes 18 are used always as anodes and the ground voltage of 0 V is applied thereto for anode drive. The X display electrodes 2 and the Y display electrodes 3 are driven by alternate anode drive (0 V) and cathode drive (negative voltage) at a discharge sustaining period $T_S$ (FIG. 15). The X display electrodes 2 are driven by anode drive while the Y display electrodes 3 are driven by cathode drive, and vice versa.

Figure 2A:
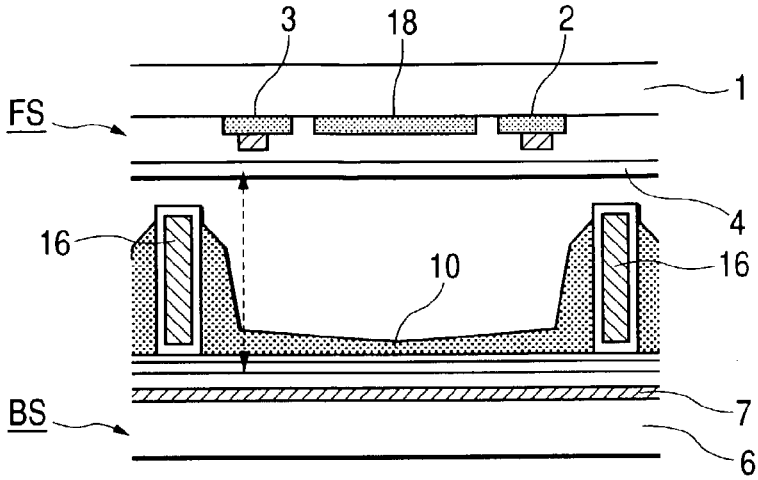
FIGS. 2A to 2C are sectional views of assistance in explaining an operation of driving the plasma display panel in the first embodiment.

FIG. 2A shows a state in an address discharge period $T_A$. Addressing method is either a lighting cell selection method that uses a discharge to select cells to be lighted or an unlighting cell selection method that uses a discharge to select unlighting cells. The lighting cell selection method forms an address discharge by applying an address pulse of a negative voltage to the address electrode 7 and a pulse of a positive voltage higher than that applied to the metal barrier ribs 16 to the Y display electrode 3 to charge the Y display electrode 3 by a negative wall charge. In the following discharge sustaining period $T_S$, the wall charge produces a forward bias voltage to light the cell. Then, a discharge occurs between the Y display electrode 3 and the metal barrier rib 16, the discharge propagates toward the address electrode 7 driven by cathode drive, and a discharge occurs in the discharge space 11 between the address electrode 7 and the Y display electrode 3. Consequently, a wall charge (negative wall charge) necessary for causing a narrow pulse discharge in the discharge sustaining period $T_S$ is accumulated in a part near the Y display electrode 3 of the protective film 4. The cell charged with a wall charge lights.

The unlighting cell selection method applies a negative pulse voltage to the Y display electrode 3 and applies a voltage pulse of a voltage higher than that of the metal barrier rib 16 to cause an address discharge. Thus, a discharge occurs in the discharge space 11 through a process similar to that mentioned above to charge the Y display electrode 3 by a wall charge (positive wall charge) that does not cause any narrow pulse discharge. A revere bias voltage is produced in the cell in which the positive wall charge is accumulated, any narrow pulse discharge does not occur, and the cell does not light and remains in an unlighting cell.

Figure 2B:
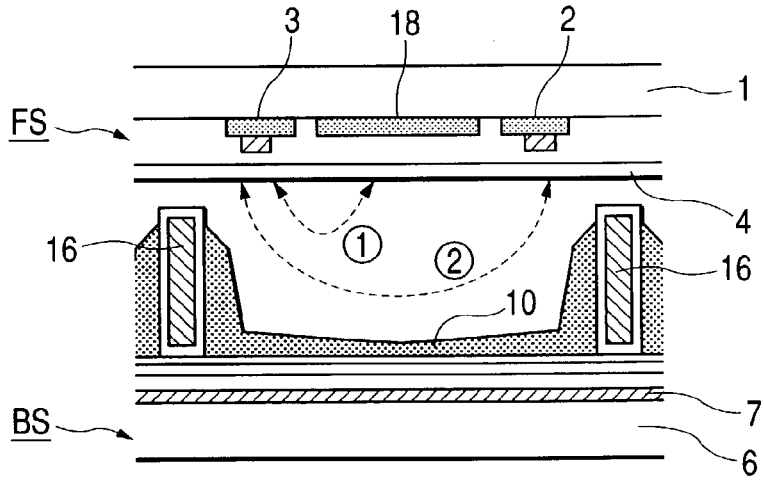
Figure 2C:
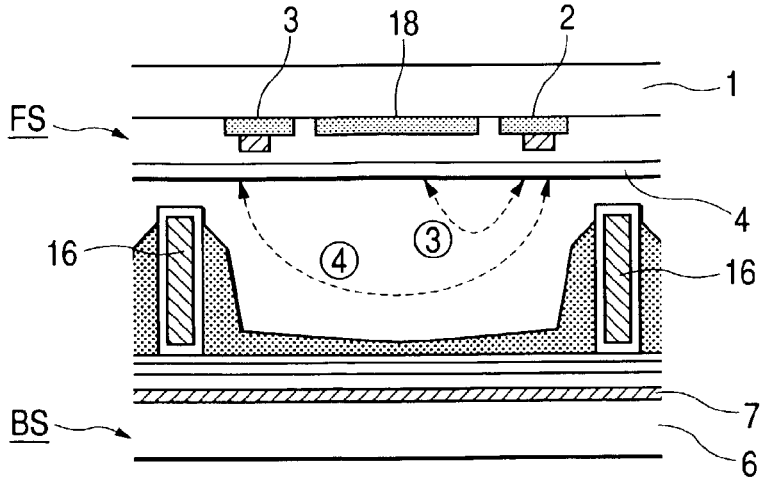

Referring to FIG. 2B, in the discharge sustaining period $T_S$, a negative pulse voltage is applied to the Y display electrode 3 for cathode drive, the intermediate electrode 18 is maintained at 0 V for anode drive and, at the same time, the ground voltage of 0 V is applied to the X display electrode 2 for anode drive. Consequently, the negative voltage applied to the Y display electrode 3 is added to the wall charge, a voltage corresponding to the sum of the negative voltage and the wall charge is applied across the Y display electrode 3 and the intermediate electrode 18 as indicated by the arrows ① to charge the Y display electrode 3 and the intermediate electrode 18. When the short gap electrodes are charged sufficiently and a high-intensity electric field is created, a discharge occurs around the Y display electrode 3, and then, as indicated by the arrows ②, a discharge occurs between the Y display electrode 3 and the X display electrode 2, high-intensity ultraviolet rays are produced to excite the fluorescent layer 10. Discharge efficiency is improved greatly and visible light with high-intensity is emitted by a narrow pulse discharge. A narrow pulse current flows through the Y display electrode 3 and the X display electrode 2 in a short period of this discharge. The function of the intermediate electrode 18 during the discharge is similar to that of the metal barrier rib 16. The intermediate electrode 18 and the metal barrier rib 16 form a discharge passage for generating the narrow pulse.

A period between the application of the negative pulse voltage to the Y display electrode 3 to start charging between the Y display electrode 3 and the intermediate electrode 18 and the completion of the discharge is a very short period on the order of 200 μs or below. Most part of the narrow pulse current flows between the Y display electrode 3 and the X display electrode 2.

A negative wall charge remains on a part near the X display electrode 2 of the protective film 4 after the completion of the foregoing operation. In the next operation, a negative pulse voltage is applied to the X display electrode 2 for cathode drive, the intermediate electrode 18 is kept at 0 V for anode drive, and the ground voltage is applied to the Y display electrode 3 for anode drive. Consequently, the negative voltage applied to the X display electrode 2 is added to the wall charge, a voltage corresponding to the addition of the negative voltage and the wall charge is applied across the X display electrode 2 and the intermediate electrode 18 as indicated by the arrows ③ to charge the X display electrode 2 and the intermediate electrode 18. When the X display electrode 2 and the intermediate electrode 18 are charged sufficiently and a high-intensity electric field is created, a discharge occurs around the X display electrode 2, and then, as indicated by the arrows ④, an instant discharge occurs between the X display electrode 2 and the Y display electrode 3, high-intensity ultraviolet rays are produced to excite the fluorescent layer 10 and, as mentioned above, visible light with high-intensity is emitted. A narrow pulse current flows through the X display electrode 2 and the Y display electrode 3 in a short period of the breakdown discharge. A negative wall charge remains on a part near the X display electrode 2 of the protective film 4 after the termination of the discharge, and the operation described in connection with FIG. 2B is performed again.

Thus, the discharge (narrow pulse discharge) involving the narrow pulse current occurs, and the fluorescent layer 10 excited by the ultraviolet rays produced by the discharge emits visible light. Since the intense narrow pulse discharge occurs in a short time, intense ultraviolet rays are produced, and hence a high discharge efficiency can be attained.

Figure 3A:
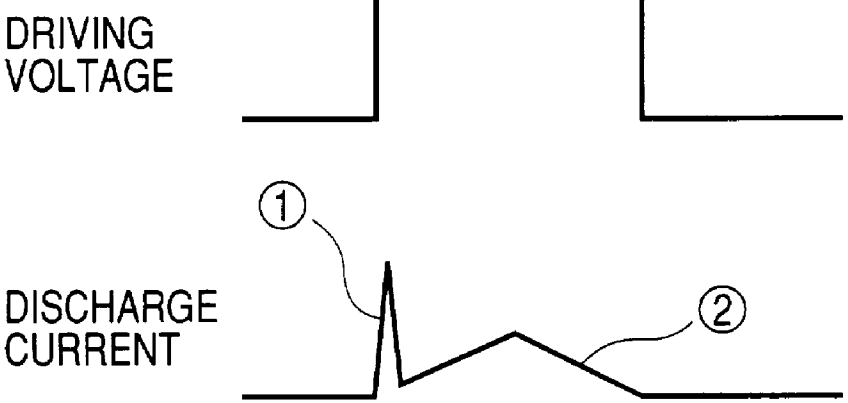
FIGS. 3A and 3B are diagrams respectively showing discharge currents in a conventional plasma display panel and the plasma display panel in the first embodiment.
Figure 3B:
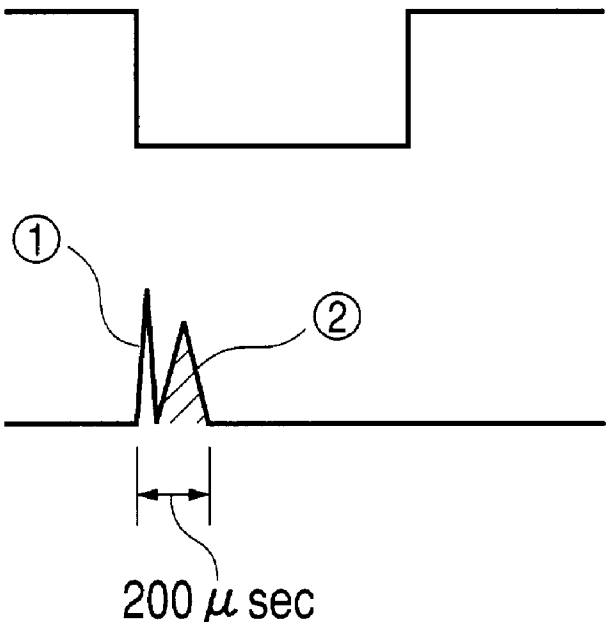

FIGS. 3A and 3B are diagrams respectively showing discharge currents (②) in a conventional plasma display panel using a conventional negative glow discharge and the plasma display panel in the first embodiment.

As shown in FIG. 3A, in the conventional plasma display panel, a discharge current flows through the display electrodes, i.e., the X and the Y display electrode, for a long time and a glow discharge continues for the long time and visible light is emitted when a driving voltage is applied to the display electrodes. As shown in FIG. 3B, in the plasma display panel in the first embodiment, a narrow pulse discharge continues for a short time of about 200 μs after the application of a negative driving voltage to the display electrodes, and a pulse current flows through the display electrodes only for the short time.

Thus, the discharge for emitting visible light continues for a very short discharge time in the plasma display panel in the first embodiment, and a narrow pulse current flows through the display electrodes during the discharge time. Therefore, the intensity of the ultraviolet rays produced in the plasma display panel in the first embodiment, as compared with that of ultraviolet rays produced in the conventional plasma display panel, is very high, and discharge efficiency is improved remarkably. Since the intense narrow pulse discharge occurs in an instant, the luminance of lighted cell is very high. Thus, the plasma display panel in the first embodiment is able to operate at high luminous efficiency and to improve luminance remarkably.

Figure 4A:
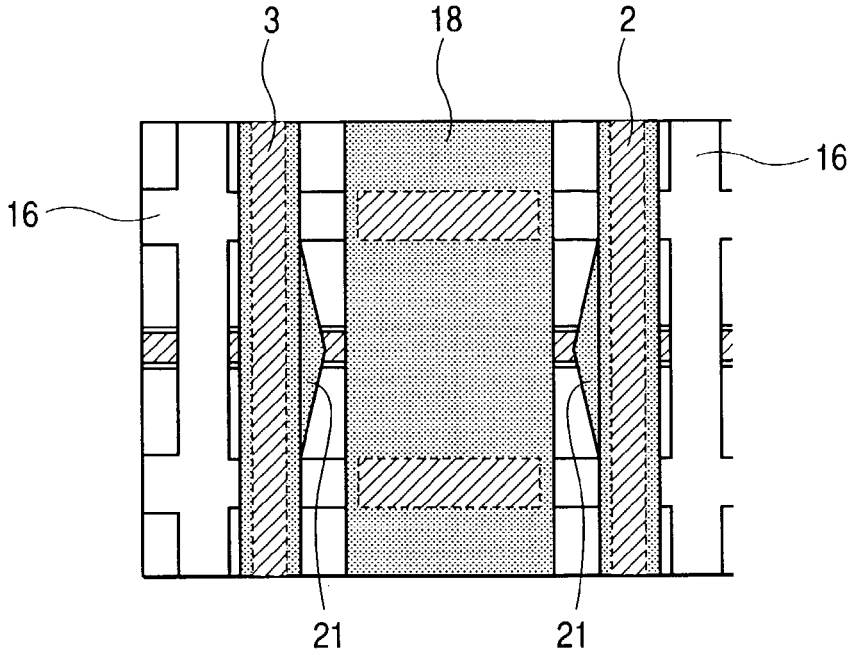
FIGS. 4A and 4B are plan views of capacitive coupling enhancing means for enhancing the capacitive coupling of a display electrode and an intermediate electrode in the plasma display panel in the first embodiment.

The intervals between the display electrodes, i.e., the X and the Y display electrode 2 and 3, and the intermediate electrode 18 must be set as adequately as possible to form a structure capable of generating a discharge using a low voltage, and the input voltage must be decreased to generate a narrow pulse discharge efficiently, which is particularly necessary when Xe gas that requires a high discharge voltage is used. FIG. 4 shows structures capable of meeting such requirements. FIG. 4A shows a structure in which the display electrodes 2 and 3 are provided with projections 21, and FIG. 4B shows a structure in which the intermediate electrode 18 is provided with projections 22 and 23 similar to the projections 21.

Referring to FIG. 4A showing a single cell, the projections 21 having a shape resembling an isosceles triangle are formed on sides facing the intermediate electrode 18 of the display electrodes 2 and 3. The tips of the projections 21 are close to the intermediate electrode 18, and the distance between the tips of the projections 21 and the intermediate electrode 18 is as short as the distance mentioned above. Thus, intense electric fields are created easily between the tips of the projections 21 and parts corresponding to the tips of the projections 21 of the intermediate electrode 18, so that the discharge voltage can be efficiently reduced.

Figure 4B:
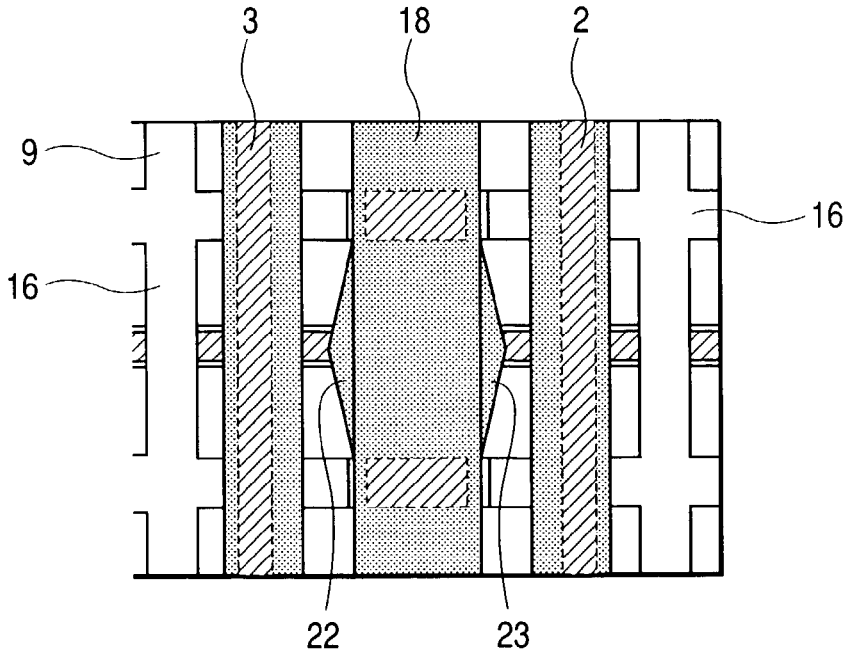

In FIG. 4B, the projections 22 and 23 similar in shape to the projections 21 shown in FIG. 4A are formed on the opposite sides facing the display electrodes 2 and 3 of the intermediate electrode 18. The structures shown in FIGS. 4A and 4B have the same effect.

Although the projections 21, 22 and 23 sown in FIG. 4 have the shape resembling an isosceles triangle, projections of any suitable shape, such as a shape resembling a segment of a circle, may be used instead of the projections 21, 22 and 23, provided that the projections have a width narrowing toward their extremities.

The plasma display panel in the first embodiment shown in FIG. 1 is provided with the intermediate electrodes 18 of a nonmetallic transparent film, such as an ITO film, having a large resistance. Therefore, when the ground voltage is applied to the intermediate electrode 18, the potential of a part of the intermediate electrode 18 remote from a point of application of the ground voltage is affected by the floating potential of a nearby electrode. For example, when a negative voltage is applied to the Y display electrode 3, the potential of the intermediate electrode 18 approaches the negative potential of the Y display electrode 3 due to the influence of floating capacity between the intermediate electrode 18 and the Y display electrode 3. If such a phenomenon occurs when the Y display electrode 3 and the intermediate electrode 18 are charged, the intermediate electrode 18 and the Y display electrode 3 cannot be charged so as to provide a sufficiently large potential difference between the Y display electrode 3 and the intermediate electrode 18, satisfactory charging cannot be achieved, and hence it is difficult to create an intense electric field to generate a stable discharge.

To solve such a problem, all the parts of the intermediate electrode 18, similarly to the metal barrier ribs 16, must be stably held at the ground potential.

As shown in FIGS. 1A and 1B, the projections 16*a* are formed in parts intersecting the intermediate electrode 18 of metal barrier ribs 16 to reduce the distance between the metal barrier ribs 16 and the intermediate electrode 18. The projections 16*a* enhance the capacitive coupling of the intermediate electrode 18 and the metal barrier ribs 16, and the potential of the intermediate electrode 18 is able to approach the potential of the metal barrier ribs 16 easily. Since the ground voltage is applied continuously to the metal barrier ribs 16, the potential of any part of the metal barrier ribs 16 is equal to the ground potential of 0 V. Therefore, the intermediate electrode 18 is kept at the ground potential even if a negative voltage is applied to the display electrodes 2 and 3.

Figure 5A:
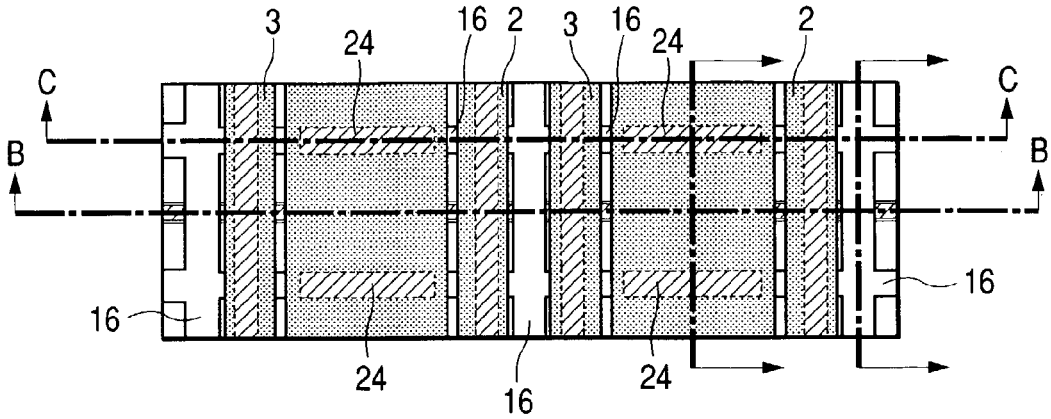
FIGS. 5A to 5C are views of a plasma display panel in a second embodiment according to the present invention.
Figure 5B:
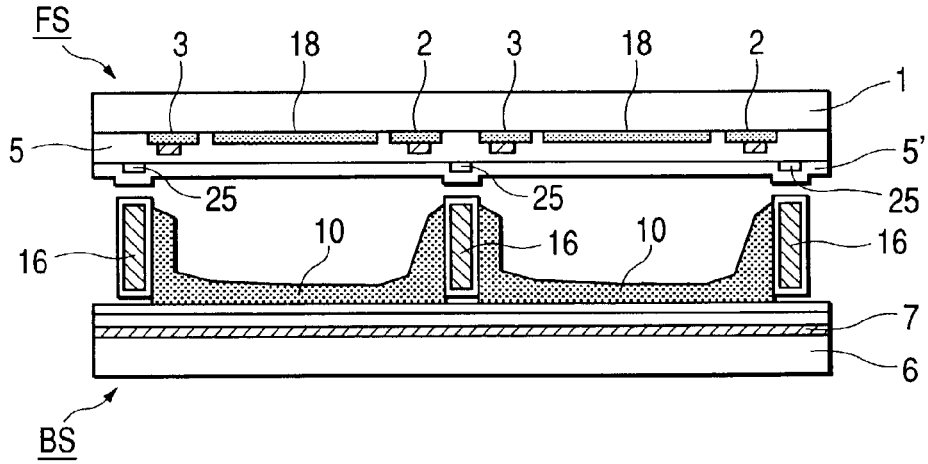
Figure 5C:
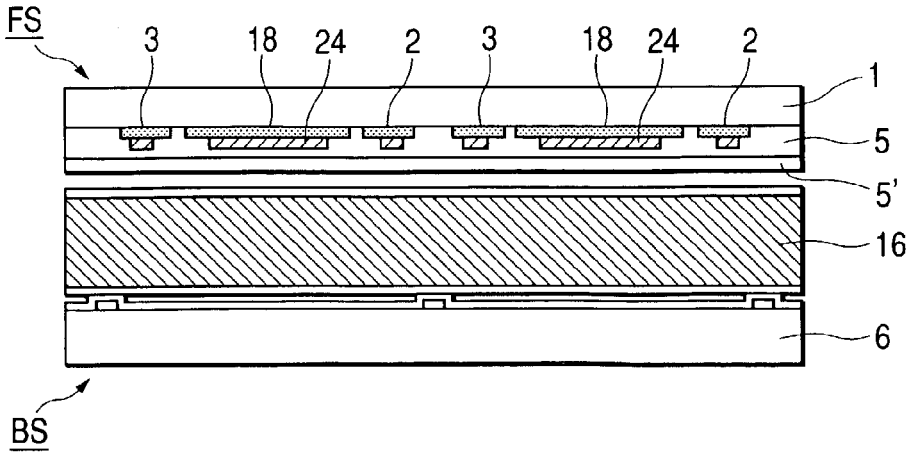

FIG. 5 shows a plasma display panel in a second embodiment according to the present invention, in which FIG. 5A is a plan view taken from the side of a front glass substrate, FIG. 5B is a longitudinal sectional view taken on line B-B in FIG. 5A, and FIG. 5C is a longitudinal sectional view taken on line C-C in FIG. 5A. Shown in FIGS. 5A to 5C are a protective layer 5', a conductive layer 24 and projections 25. In FIGS. 5A to 5C, parts like or corresponding to those shown in FIGS. 1A to 1D are denoted by the same reference characters and the description thereof will be omitted to avoid duplication.

Referring to FIG. 5B, which corresponds to FIG. 1B, a dielectric layer 5 is formed on a surface facing metal barrier ribs 16 of a front substrate FS, and the dielectric projections 25 are formed on the dielectric layer 5 along the metal barrier ribs 16 for each cell. The plasma display panel in the second embodiment is the same in other respects as that in the first embodiment. The dielectric projections 25 separate adjacent cells. Therefore, an X display electrode 2 of one of the two adjacent cells and a Y display electrode 3 of the other cell can be disposed close to each other and, consequently, the gap length in each cell can be increased to increase the aperture ratio of each cell.

Referring to FIG. 5C, which corresponds to FIG. 1C, conductive layers 24 are formed on parts intersecting the metal barrier ribs 16 of a surface facing the metal barrier ribs 16 of the intermediate electrode 18. The conductive layers 24 reduce the distance between the intermediate electrode 18 and the metal barrier rib 16 to enhance the capacitive coupling of the intermediate electrode 18 and the metal barrier rib 16 so that the intermediate electrode 18 is stabilized at the potential of the metal barrier rib 16. As shown in FIG. 1C, in the plasma display panel in the first embodiment, the metal barrier rib 16 is provided with the projections 16*a* to enhance the capacitive coupling. In the plasma display panel in the second embodiment, the conductive layers 24 corresponding to the projections are combined with the intermediate electrode 18 to provide the same effect as that of the first embodiment.

The plasma display panel in the second embodiment is similar to the plasma display panel in the first embodiment in other respects including those described in connection with FIG. 4.

Figure 6:
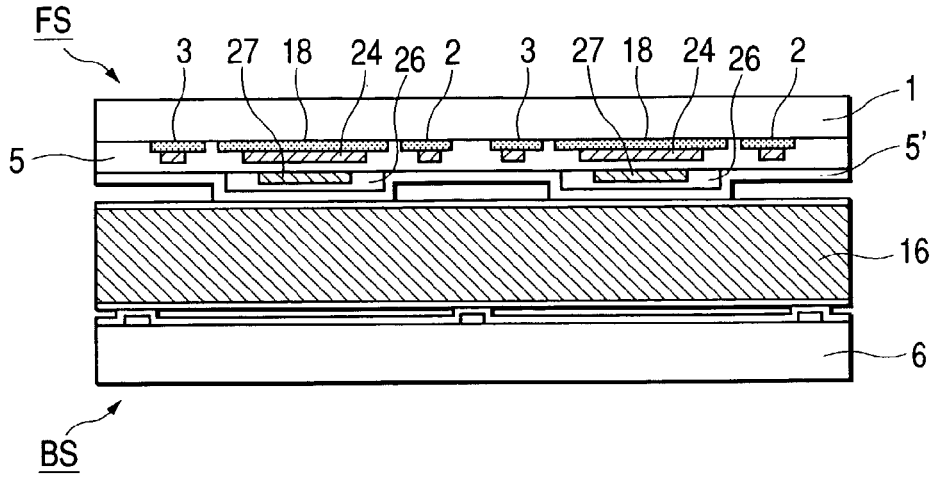
FIG. 6 is a typical sectional view of an essential part of a plasma display panel in a third embodiment according to the present invention.

FIG. 6 is a typical sectional view of an essential part around a metal barrier rib 16 of a plasma display panel in a third embodiment according to the present invention, in which parts like or corresponding to those shown in FIG. 5 are denoted by the same reference characters and the description thereof will be omitted.

Referring to FIG. 6, projections are formed along thee metal barrier rib 16 in parts corresponding to intersections of intermediate electrodes 18 and the metal barrier ribs 16 of a surface of a front substrate FS. Each projection consists of a conductive layer 27, and a part corresponding to the conductive layer 27 of a dielectric layer 26 covering the conductive layer 27. A conductive layer 24 is formed on the intermediate electrode 18 similarly to the conductive layer 24 of the second embodiment shown in FIG. 5C. The conductive layers 24 and 27 further enhances the capacitive coupling of the intermediate electrode 18 and the metal barrier rib 16 and the intermediate electrode 18 can be further stably kept at ground potential.

Figure 7:
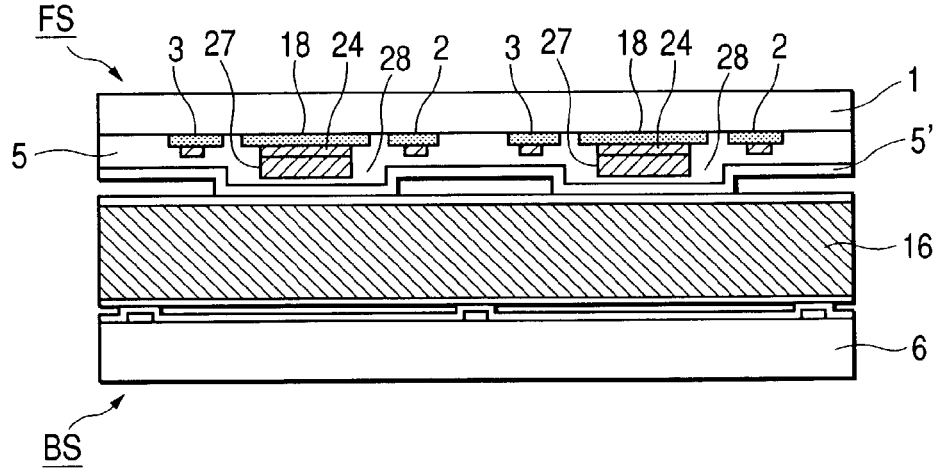
FIG. 7 is a typical sectional view of an essential part of a plasma display panel in a fourth embodiment according to the present invention.

FIG. 7 is a typical sectional view of an essential part around a metal barrier rib 16 of a plasma display panel in a fourth embodiment according to the present invention, in which parts like or corresponding to those shown in FIG. 6 are denoted by the same reference characters and the description thereof will be omitted to avoid duplication. In FIG. 7, indicated at 28 are projections formed in a dielectric layer 5.

As shown in FIG. 7, the projections 28 are formed along the metal barrier rib 16 in parts corresponding to intersections of intermediate electrodes 18 and the metal barrier rib 16 of the dielectric layer 5 formed on a front substrate FS. Conductive layers 27 formed on conductive layers 24 formed on the intermediate electrodes 18 are coated with the dielectric layer 5.

The conductive layers 24 and 27 further reduce the distance between the intermediate electrode 18 and the metal barrier rib 16. The effect of the fourth embodiment is the same as that of the third embodiment.

Figure 8:
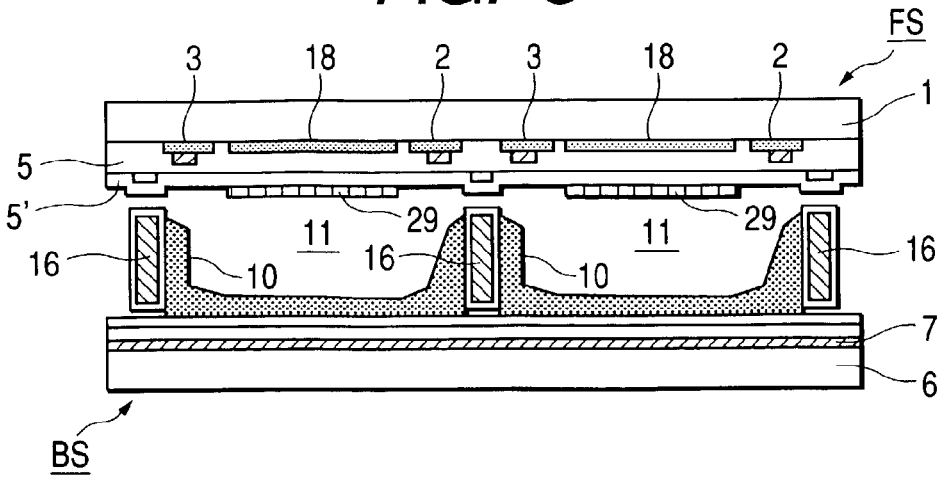
FIG. 8 is a typical sectional view of an essential part of a plasma display panel in a fifth embodiment according to the present invention.

FIG. 8 is a typical sectional view of an essential part around a discharge space 11 of a plasma display panel in a fifth embodiment according to the present invention, in which parts like or corresponding to those shown in FIG. 5B are denoted by the same reference characters and the description thereof will be omitted to avoid duplication. In FIG. 8 indicated at 29 are fluorescent layers.

As shown in FIG. 8, the fluorescent layer 29 is formed on a part corresponding to each cell of a protective layer 5' formed on a front substrate FS. When a discharge occurs between display electrodes 2 and 3, an intermediate electrode 18 functions similarly to a metal barrier rib 16, the intermediate electrode 18 and the metal barrier rib 16 form a discharge passage in the discharge space 11, and ultraviolet rays are produced in the discharge space 11. The ultraviolet rays excite both a fluorescent layer 10 formed on the metal barrier ribs 16 and the fluorescent layer 29 formed on the front substrate FS. Thus, luminous efficiency is improved remarkably.

It goes without saying that the configuration of the firth embodiment is applicable to the foregoing first to fourth embodiments.

Figure 9A:
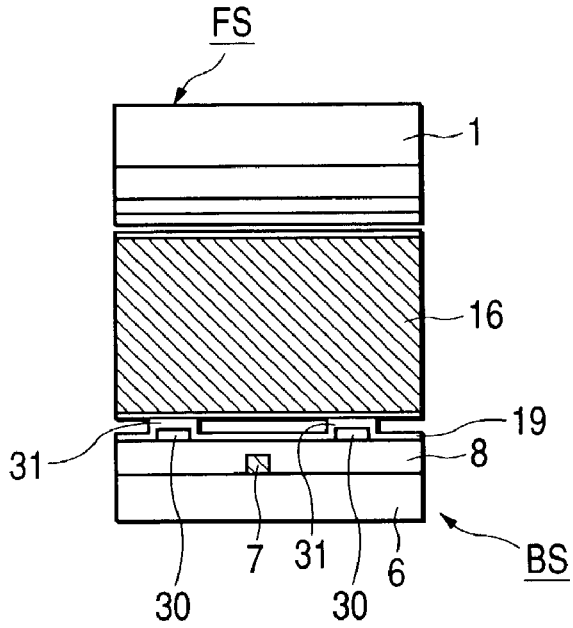
FIGS. 9A and 9B are views of an essential part of a plasma display panel in a sixth embodiment according to the present invention.
Figure 9B:
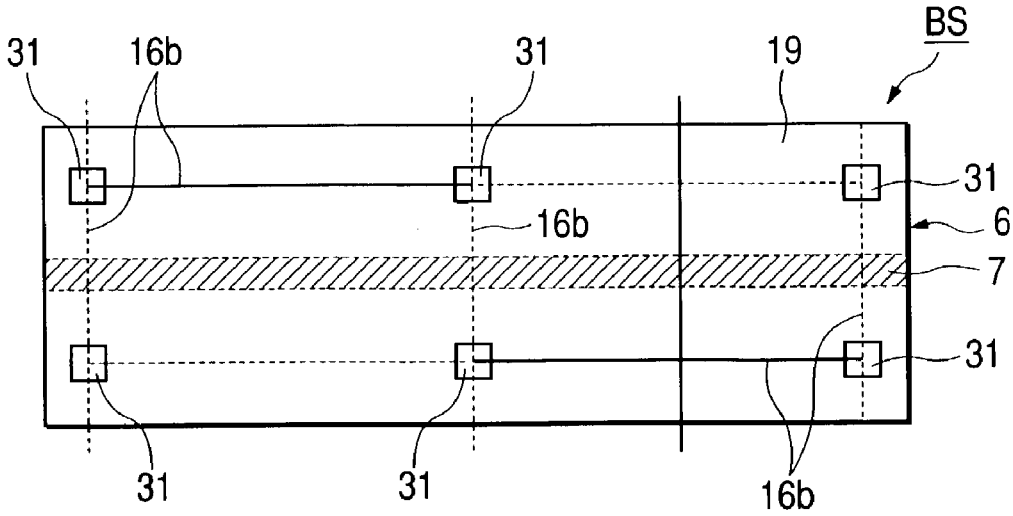

FIGS. 9A and 9B are views of an essential part of a plasma display panel in a sixth embodiment according to the present invention, in which parts like or corresponding to those of the foregoing embodiments are denoted by the same reference characters and the description thereof will be omitted to avoid duplication. FIG. 9A is a longitudinal sectional view in a plane perpendicular to address electrodes 7 passing metal barrier ribs 16, and FIG. 9B is a plan view of the back surface of a back glass substrate BS. Shown in FIGS. 9A and 9B are centerlines 16*b* of the metal barrier ribs 16, dielectric projections 30, and a protective layer 31.

As shown in FIG. 9A, the dielectric projections 30 are formed on a dielectric layer 8 formed on the back substrate BS and are covered with a protective layer 19, such as a MgO film, to form pads 31. The protective layer 19 covering the projections 30 is in contact with an insulating layer 17 formed on the metal barrier ribs 16. The pads 31 formed by coating the projections 30 with the protective layer 19 serve as bases for the metal barrier ribs 16 to support the metal barrier ribs 16 thereon. Thus the address electrodes 7 and the metal barrier ribs 16 are kept at a fixed interval and the capacitive coupling between them is reduced.

As shown in FIG. 9B, the pads 31 are formed at the intersections of centerlines 16*b* of longitudinal metal barrier ribs 16 and those of the transverse metal barrier ribs 16 corresponding to the four corners of each cell.

In the plasma display panel in the first embodiment, the hollows 20 are made by recessing parts of the metal barrier ribs 16 corresponding to the address electrodes 7 as shown in FIG. 1D to increase the distance between the address electrodes 7 and the metal barrier ribs 16. In the sixth embodiment, the pads 31 for the metal barrier ribs 16 are formed on the back substrate BS to increase the distance between the address electrodes 7 and the metal barrier ribs 16. Thus, the sixth embodiment does not need a process for forming the recesses in the metal barrier ribs 16 with high positional accuracy.

It goes without saying that the configuration of the sixth embodiment is applicable to the first to the fifth embodiment.

The foregoing embodiments use the intermediate electrodes 18 for causing a narrow pulse discharge. The metal barrier ribs 16 may be used for causing a narrow pulse discharge. When the metal barrier ribs 16 are used, the X display electrodes 2, the Y display electrodes 3, and the metal barrier ribs 16 are formed at small intervals to concentrate an electric field, the capacitive coupling of those electrodes is reduced, for example, by coating the surfaces facing the metal barrier ribs 16 of the X display electrodes 2 and the Y display electrodes 3 with a conductive layer to reduce the distance between the display electrodes 2 and 3, and the metal barrier ribs 16, so that the electrodes can be rapidly charged. Since the intermediate electrodes 18 function only as the metal barrier ribs and the construction explained in connection with FIG. 4 is not necessary.

A driving method of driving the plasma display panels in the foregoing embodiments as applied to a display will be described.

Figure 10:
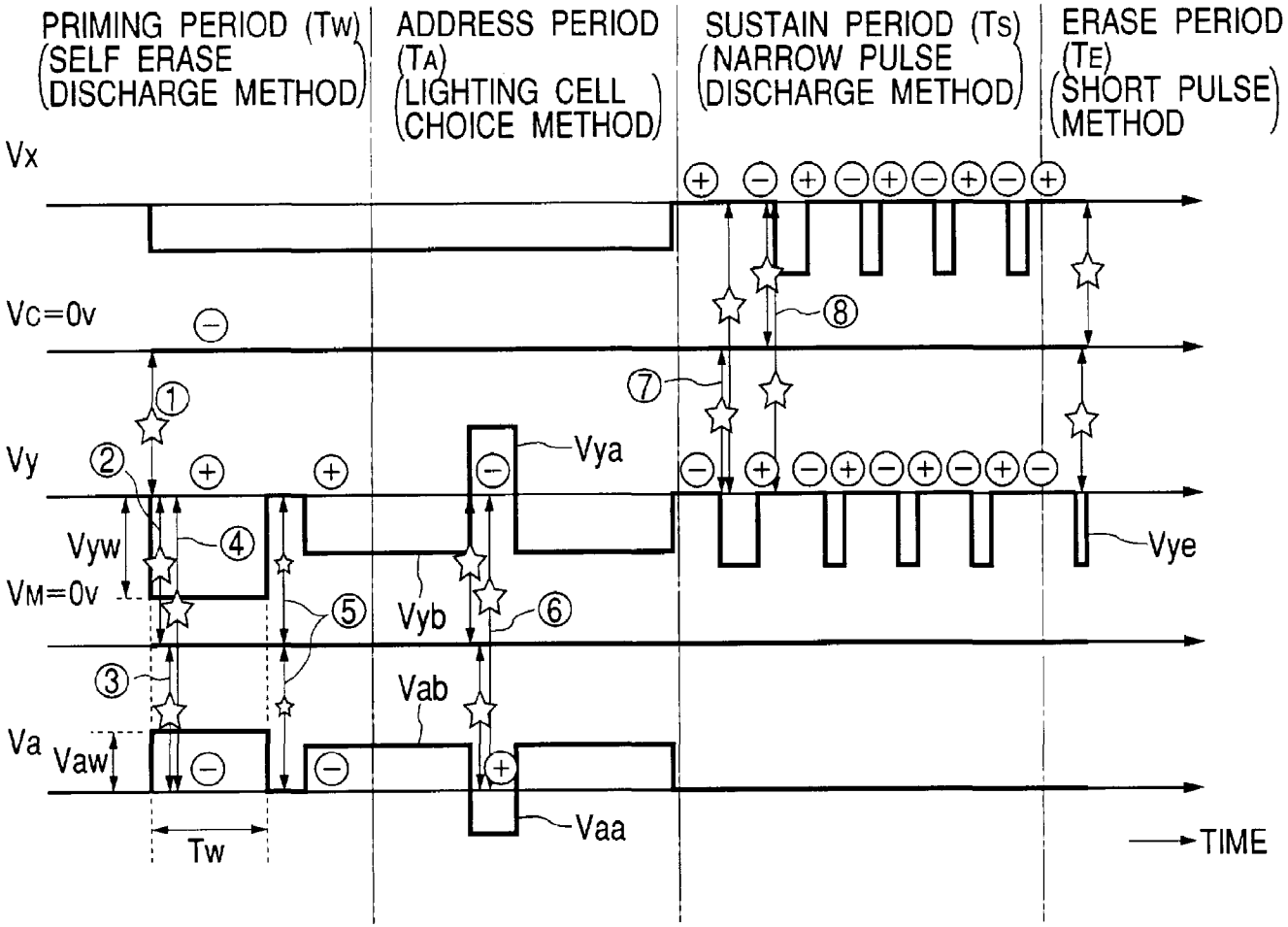
FIG. 10 is a diagram of assistance in explaining a first driving method of driving a plasma display panel according to the present invention included in a display.
Figure 14:
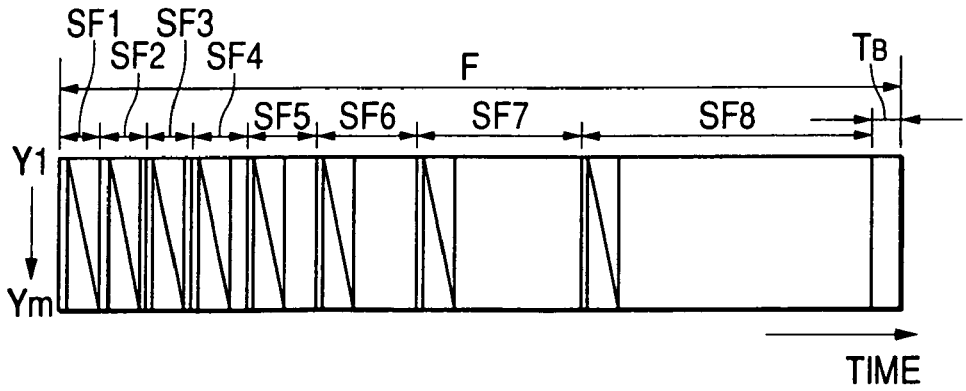
FIG. 14 PRIOR ART
FIG. 14 is a diagrammatic view of assistance in explaining a method of driving a field of an AC type plasma display panel.

FIG. 10 is a diagrammatic view of assistance in explaining a first driving method of driving the plasma display panel according to the present invention by way of example. FIG. 10 shows the waveforms of voltage $V_x$ applied to the X display electrode 2, voltage $V_c$ (0 V) applied to the intermediate electrode 18, voltage $V_y$ applied to the Y display electrode 3, voltage $V_M$ (0 V) applied to the metal barrier rib 16 and voltage $V_a$ applied to the address electrode 7 in one subfield SF shown in FIG. 14. In FIG. 10 time is measured on the horizontal axis, large stars indicate high-energy discharges between electrodes connected by the arrows, and small stars indicate low-energy discharges between electrodes connected by the arrows.

Referring to FIG. 10, the subfield SF, as explained previously in connection with FIG. 15, the subfield SF consists of a priming and erase discharge period $T_W$, an address discharge period $T_A$ and a discharge sustaining period $T_S$. The discharge sustaining $T_S$ is followed by an erase period $T_E$. A self erase discharge method is performed in the priming period $T_W$ to accumulate wall charges in all the cells. A lighting cell selection method is carried out in the address discharge period $T_A$ to select cells to be discharged. A narrow pulse discharge method is carried out in the discharge sustaining period $T_S$ to make the discharged cells emit light. A short pulse method is carried out in the erase period $T_E$.

In the first subfield SF1, a negative voltage $V_y$ ($=-V_{yw}$) is applied to the Y display electrodes 3, and simultaneously a positive voltage $V_a$ ($=+V_{aw}$) is applied to the address electrodes 7 for the priming period $T_W$. Since the cells contain few charged particles, the voltages $V_{yw}$ and $V_{aw}$ are comparatively high voltages to produce charged particles in the cells. For example, $-V_{yw}=-240$ V and $+V_{aw}=+100$ V.

When the intermediate electrodes 18 driven by anode drive using 0 V are close to the display electrodes 2 and 3, a discharge ① occurs between the Y display electrode 3 driven by cathode drive using the negative voltage $V_y$ ($=-V_{yw}$) and the intermediate electrode 18, and then this discharge causes a discharge ② to occur between the Y display electrode 3 and the metal barrier rib 16 driven by anode drive using 0 V. The discharge spreads and a discharge ③ occurs between the metal barrier rib 16 and the address electrode 7 driven by anode drive using the positive voltage $V_a$ ($=+V_{aw}$) higher than the voltage applied to the metal barrier rib 16. Eventually a discharge ④ occurs between the Y display electrode 3 and the address electrode 7. The discharge ④ produces charged particles in the discharge space 11, the Y display electrode 3 is charged with a positive wall charge and the address electrode 7 is charged with a negative wall charge.

Those electrodes are charged with wall charges in an instant. The priming period $T_W$ necessary for producing a sufficient wall charge by applying the voltages $V_{yw}$ and $V_{aw}$ is in the range of about 10 to about 100 s.

The foregoing operation is performed for all the cells to accumulate the wall charges in the cells. This is an initial priming operation for one field. In each of the subfields of one field, the space charge produced in the erase period in the preceding subfield is converted into a wall charge and hence the initial priming operation is not performed. The voltages $V_{yw}$ and $V_{aw}$ are low because the wall charge is produced without discharging.

After the wall charge has been accumulated and the priming operation has been completed, the voltages $V_{yw}$ and $V_{aw}$ are removed. After the voltages $V_y$ and $V_a$ respectively applied to the Y display electrode 3 and the address electrode 7 go 0 V, the Y display electrode 3 and the address electrode 7 are held by the positive wall charge and the negative wall charge in a state where a positive voltage is applied to the Y display electrode 3 and a negative voltage is applied to the address electrode 7, respectively, and, consequently, a discharge ⑤, i.e., a self erase discharge, occurs between the Y display electrode 3 and the address electrode 7, and positive and negative charged particles are produced in the discharge space 11. If this state is sustained, the mutual neutralization of the positive and the negative charged particles progresses in the discharge space 11. A predetermined negative voltage $V_y$($=-V_{yb}$) and a predetermined positive voltage $V_a$ ($=+V_{ab}$) are applied to the Y display electrode 3 and the address electrode 7, respectively, before the neutralization progresses to attract positive charged particles and negative charged particles to the Y display electrode 3 and the address electrode 7, respectively. Thus, the Y display electrodes 3 and the address electrodes 7 of all the cells are charged with a positive wall charge and a negative wall charge, respectively. This is a principal priming operation in the priming period $T_W$.

The address discharge period $T_A$ is started after the priming period $T_W$. An address lighting cell selection method is carried out in the address discharge period $T_A$ to charge cells to light in the discharge sustaining period $T_S$ with a wall charge by an address discharge. The Y display electrode 3 is charged with the positive wall charge by the priming operation. In the discharge sustaining period $T_S$, the negative voltage $V_y$ is applied to the Y display electrodes charged with a negative wall charge for forward biasing to form lighting cells. Thus a narrow pulse discharge is generated between the Y display electrode and the X display electrode 2. When an unlighting cell is selected in the address period $T_A$, the Y display electrode 3 is charged with a positive wall charge. Therefore, the Y display electrode 3 is reverse biased by the negative voltage $V_y$ and such a narrow pulse discharge does not occur.

The address lighting cell selection method applies a positive voltage $V_y$ ($=+V_{ya}$) to the Y display electrode 3, and a negative voltage $V_a$ ($=-V_{aa}$) to the address electrode 7, at the time of addressing, to cause a discharge ⑥ between the Y display electrode 3 and the address electrode 7. The discharge ⑥ occurs first between the Y display electrode 3 and the metal barrier rib 16 of 0 V and the discharge ⑥ spreads to the address electrode 7 of the negative voltage. The discharge ⑥ charges the Y display electrode 3 with a negative wall charge, and the address electrode 7 with a positive wall charge. Subsequently, the predetermined negative voltage $V_y$ and the predetermined positive voltage $V_a$ are applied to the Y display electrode 3 and the address electrode 7, respectively, and the address discharge period $T_A$ ends.

As mentioned above in connection with FIG. 2, a negative voltage is applied to the Y display electrode 3 in the discharge sustaining period $T_S$ to charge a lighting cell with a wall charge at a wall voltage. Consequently, charging occurs between the Y display electrode 3 and the intermediate electrode 18, and a sufficient voltage is produced between the Y display electrode 3 and the intermediate electrode 18. Then, a narrow pulse discharge ⑦ occurs between the Y display electrode 3 and the X display electrode 2, ultraviolet rays are produced in the cell, and the cell emits visible light. After the narrow pulse discharge ⑦ has ended, the X display electrode 2 is charged with a negative wall charge. Subsequently, a negative voltage $V_x$ is applied to the X display electrode 2 to generate a narrow pulse discharge ⑧. Similarly, those operations are repeated predetermined times to complete a sustaining narrow pulse discharge method.

In a state at the completion of the discharge by the sustaining narrow pulse discharge method, the X display electrode 2 and the Y display electrode 3 are charged with a positive wall charge and a negative wall charge, respectively. A short pulse method is carried out to remove the negative wall charge from the Y display electrode 3. The short pulse method applies a short pulse of a negative voltage $V_y$ (=$-V_{ye}$) to the Y display electrode 3. The negative voltage $V_y$ causes a discharge. Since the negative voltage $V_y$ is applied only for a short time, the Y display electrode 3 is not charged with any wall charge, the negative wall charge is removed from the Y display electrode 3 and is neutralized in the discharge space 11. If the negative voltage is applied for a long time, newly produced charged particles charge the X display electrode 2 and the Y display electrode 3 with a negative wall charge and a positive wall charge, respectively. Therefore, a short pulse of a negative voltage $V_y$ (=$-V_{ye}$) is applied to the Y display electrode 3 to avoid such charging of the X display electrode 2 and the Y display electrode 3.

The driving operation of driving the first subfield SF1 is completed in the field period. The conventional plasma display panel performs the foregoing driving method for the other subfields SF2, SF3, . . . and SF8. Since an intense discharge occurs in an initial stage of the priming period, intense ultraviolet rays are produced in the discharge spaces 11, the intense ultraviolet rays excite the fluorescent layers 10 and a considerably large quantity of visible light is emitted, which reduces the contrast of displayed pictures.

The plasma display panel of the present invention employs the foregoing driving method for the first subfield SF1 of each field F, and does not generate an intense discharge in the priming period for the following subfields SF2, SF3, . . . and SF8, and achieves priming only by a self erase discharge. If the first subfield SF1 is not lighted first, the second subfield SF2 is lighted.

Referring to FIG. 10, in the priming period $T_W$, initial addressing is not necessarily performed and any charged particles are not newly produced. Charged particles produced while the short pulse method is being carried out in the final stage of the discharge sustaining period $T_S$ are used. The negative voltage $V_y$ (=$-V_{ye}$) is applied to the Y display electrode 3 for a time (pulse period) equal to a short time on the order of 0.4 μs necessary to remove the positive wall charge and the negative wall charge respectively from the X display electrode 2 and the Y display electrode 3 to produce charged particles. Thus, the positive wall charge and the negative wall charge removed respectively from the X display electrode 2 and the Y display electrode 3 do not neutralize each other and remain in the discharge space 11. In this state the priming period for the next subfield SF is started.

New charged particles are not produced and the charges remaining in the discharge space 11 are used in this priming period. The negative voltage $V_y$ (=$-V_{yw}$) and the positive voltage $V_a$ (=$+V_{aw}$) are applied simultaneously to the Y display electrode 3 and the address electrode 7, respectively, to collect positive charges remaining in the discharge space 11 on the Y display electrode 3 to charge the Y display electrode 3 with a positive wall charge, and to collect negative charges remaining in the discharge space 11 on the address electrode 7 to charge the address electrode 7 with a negative wall charge. Thus, the Y display electrode 3 and the address electrode 7 are charged with the predetermined wall charges, respectively, without generating any intense discharge. The voltages $-V_{yw}$ and the voltage $+V_{aw}$ are on the order of −200 V and on the order of +80 V, respectively, which are far lower than the voltages used in the initial stage for the first subfield SF1. A pulse voltage of a somewhat wide pulse width must be applied to the electrode to charge the electrode with a wall charge by attracting charges in the discharge space 11 to the electrode. The durations of application of the negative voltage $V_y$ (=$-V_{yw}$) and the positive voltage $V_a$ (=$+V_{aw}$) to the Y display electrode 3 and the address electrode 7 is, for example, in the range of about 30 to about 100 μs.

Thus, the contrast of pictures can be improved by controlling light emission in the priming period and charging the Y display electrode 3 and the address electrode 7 with the desired wall charges. The following operation is the same as that for the first subfield SF1.

Figure 11:
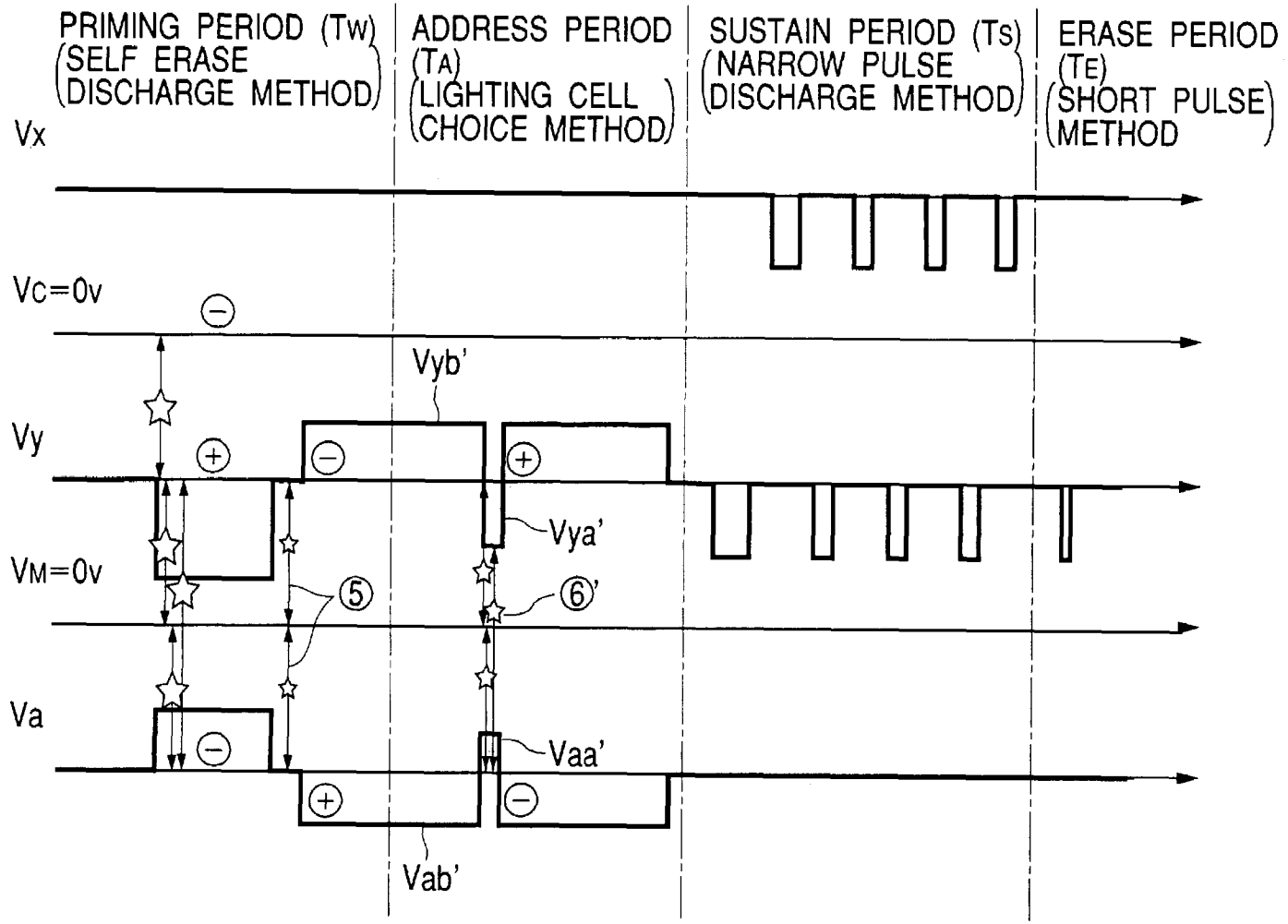
FIG. 11 is a diagram of assistance in explaining a second driving method of driving a plasma display panel according to the present invention included in a display.

FIG. 11 is a diagrammatic view of assistance in explaining a second driving method of driving the plasma display panel according to the present invention. This second driving method carries out an address unlighting cell selection method in an address discharge period $T_A$. This driving method is the same in other respects as the first driving method.

The address unlighting cell choice method chooses cells which are not lighted in a discharge sustaining period $T_S$, and removes wall charges from cells that are not lighted.

Referring to FIG. 11, operations that cause discharges ① to ⑤ are the same as those previously described in connection with FIG. 10. When the discharges ⑤ occurs, a positive wall charge and a negative wall charge are removed from the Y display electrode 3 and the address electrode 7, respectively, and charged particles are produced in the discharge space 11. If this condition is continued, the positive and negative charged particles neutralize each other. A positive voltage $V_y$(=$+V_{yb}$') and a negative voltage $V_a$ (=$-V_{ab}$') are applied to the Y display electrode 3 and the address electrode 7, respectively, before the neutralization progresses. Then, negative charged particles and positive charged particles are attracted to the Y display electrode 3 and the address electrode 7, respectively, and the Y display electrode 3 and the address electrode 7 are charged with a negative wall charge and a positive wall charge, respectively.

All the cells are thus charged with such wall charges. In this state, all the cells can be lighted in the discharge sustaining period $T_S$. The address unlighting cell selection method is carried out in the address discharge period $T_A$ to remove the wall charges from the cells not to be lighted to make those cells unable to light.

Referring to FIG. 11, after the completion of the priming self erase discharge, a negative voltage $V_y$ (=$-V_{ya}$') and a positive voltage $V_a$ (=$+V_{aa}$') are applied respectively to the Y display electrode 3 and the address electrode 7 of the cell that is not to be lighted in the discharge sustaining period $T_S$ in the address discharge period $T_A$. Consequently, a discharge ⑥' occurs between the Y display electrode 3 and the address electrode 7, and the Y display electrode 3 and the address electrode 7 are charged with a positive wall electrode and a negative wall electrode, respectively. Thus, a negative wall charge that acts for forward biasing is removed from the Y display electrode 3 of the cell, any narrow pulse discharge is unable to occur in the cell in the discharge sustaining period $T_S$, and hence the cell becomes an unlighting cell.

Any discharges are not generated in the cells desired to light in the discharge sustaining period $T_S$. Therefore, the Y display electrodes 3 of those cells are kept charged with a negative wall charge and hence the cells are able to light in the discharge sustaining period $T_S$, as explained in connection with FIG. 10.

Although the erase period $T_E$ is the last period in the subfields SFn in FIGS. 10 and 11, the same may be the first period.

As apparent from the foregoing description, according to the present invention, the cells are made to emit light by the narrow pulse discharge. Therefore, high luminous efficiency and high luminance can be achieved, and power consumption can be remarkably reduced.

The reference characters will be described to facilitate understanding the drawings.

1: Front glass substrate, 2: X display electrode, 3: Y display electrode, 6: Back glass substrate, 7: Address electrode, 10: Fluorescent layer, 11P Discharge space, 16: Metal barrier rib, 16*a*: Projection, 18: Intermediate electrode, 20: Hollow, 21 to 23: Projections, 24: Conductive layer, 25 and 26: Projections, 27: Conductive layer, 28: Projection, 29: Fluorescent layer

What is claimed is:

1. A plasma display panel comprising:

a front substrate provided with parallel first and second display electrodes for each of a plurality of cells, and transparent intermediate electrodes, each formed in a space between each of the first and second display electrodes;

a back substrate provided with address electrodes respectively for the cells, extended across the first and second electrodes;

metal barrier ribs disposed between the front and the back substrate and defining discharge spaces for the cells, the metal barrier ribs having projections formed in portions intersecting the intermediate electrodes to stabilize the intermediate electrodes at a predetermined potential, the entirety of the metal barrier ribs being insulated from the intermediate electrodes; and fluorescent layers formed in the discharge spaces;

wherein the intermediate electrodes can be controlled independently from the first and second display electrodes by using the metal barrier ribs so that a narrow pulse discharge occurs between the first and second display electrodes.

2. The plasma display panel according to claim 1, further comprising a drive means for driving the first and second display electrodes by an alternate anode drive and cathode drive such that the first or the second display electrodes are driven by the anode drive while the other display electrodes are driven by the cathode drive, and always driving the intermediate electrodes by the anode drive.

3. The plasma display panel according to claim 2, wherein the anode drive is application of a voltage of 0 V.

4. The plasma display panel according to claim 1, wherein, for each cell, the intermediate electrodes are disposed such that each gap between the intermediate electrodes and the first and second display electrodes are equal.

5. The plasma display panel according to claim 4, wherein projections projecting from each of the first and second display electrodes toward the intermediate electrodes are formed for each of the first and second display electrodes.

6. The plasma display panel according to claim 4, wherein projections projecting from the opposite sides of the intermediate electrodes toward the first and second display electrodes are formed.

7. A display using the plasma display panel according to claim 1, wherein each cell of the plasma display panel is made to emit light by a narrow pulse discharge.

8. The plasma display panel according to claim 1, wherein each of the intermediate electrodes is disposed relative to the first and second display electrodes so that a narrow pulse discharge occurs between the first and second display electrodes and the narrow discharge pulse continues for approximately 200 μs.

9. The plasma display panel according to claim 1, wherein a floating capacity between the intermediate electrodes and the metal barrier ribs is greater than a floating capacity between the display electrodes and the metal barrier ribs.

10. A plasma display panel comprising:

a front substrate provided with parallel first and second display electrodes for each of cells, and transparent intermediate electrodes, each formed in a space between the first and second display electrodes;

a back substrate provided with address electrodes extended across the first and second display electrodes;

metal barrier ribs disposed between the front and the back substrate and defining discharge spaces for the cells, the metal barrier ribs having projections formed in portions intersecting the intermediate electrodes to stabilize the intermediate electrodes at a predetermined potential, the entirety of the metal barrier ribs being insulated from the intermediate electrodes; and fluorescent layers formed in the discharge spaces;

wherein the metal barrier ribs are disposed relative to the first and second display electrodes such that a capacitance of a crossing portion between the metal barrier ribs and the first and second display electrodes is smaller than a capacitance of a crossing portion between the metal barrier ribs and the intermediate electrodes so that a narrow pulse discharge occurs between the first and the second display electrodes.

11. The plasma display panel according to claim 10, further comprising a drive means for driving the first and second display electrodes by an alternate anode drive and cathode drive such that the first or the second display electrode is driven by the anode drive while the other display electrode is driven by the cathode drive, and always driving the intermediate electrodes by the anode drive.

12. The plasma display panel according to claim 11, wherein the anode drive is application of a voltage of 0 V.

13. The plasma display panel according to claim 10, wherein the metal barrier ribs are disposed close within a predetermined distance necessary for capacitive coupling between the metal barrier ribs and the intermediate electrodes for generating a narrow pulse discharge between the first and second display electrodes.

14. The plasma display panel according to claim 10, wherein a floating capacity between the intermediate electrodes and the metal barrier ribs is greater than a floating capacity between the display electrodes and the metal barrier ribs.

15. A plasma display panel comprising:

a front substrate provided with parallel first and second display electrodes for each of a plurality of cells, and transparent intermediate electrodes, each formed in a space between each of the first and second display electrodes;

a back substrate provided with address electrodes respectively for the cells, extended across the first and second electrodes;

metal barrier ribs disposed between the front and the back substrate and defining discharge spaces for the cells; and fluorescent layers formed in the discharge spaces;

wherein the intermediate electrodes can be controlled independently from the first and second display electrodes by using the metal barrier ribs so that a narrow pulse discharge occurs between the first and second display electrodes, wherein a stabilizing means includes projections formed in portions intersecting the intermediate electrodes of the metal barrier ribs, the metal barrier ribs having projections formed in portion intersecting the intermediate electrodes to stabilize the intermediate electrodes at a predetermined potential, the entirety of the metal barrier ribs being insulated from the intermediate electrodes, and further comprising stabilizing means for stabilizing the intermediate electrodes at a predetermined potential, wherein the stabilizing means include a conductive layer formed between the intermediate electrodes and the metal barrier ribs in portions where the intermediate electrodes intersect the metal barrier ribs of the front substrate.

16. The plasma display panel according to claim 15, wherein the conductive layer is disposed on the intermediate electrodes.

17. The plasma display panel according to claim 15, wherein a dielectric layer is formed on one surface of the front substrate, facing the back substrate, and projections are formed in the dielectric layer, and the conductive layer is disposed in the projections.

18. The plasma display panel according to claim 15, wherein a floating capacity between the intermediate electrodes and the metal barrier ribs is greater than a floating capacity between the display electrodes and the metal barrier ribs.

19. A plasma display panel comprising:

a front substrate provided with parallel first and second display electrodes for each of a plurality of cells, and transparent intermediate electrodes, each formed in a space between each of the first and second display electrodes;

a back substrate provided with address electrodes respectively for the cells, extended across the first and second electrodes;

metal barrier ribs disposed between the front and the back substrate and defining discharge spaces for the cells having parts intersecting the intermediate electrodes, wherein a predetermined potential is applied to said metal barrier ribs, and wherein the entirety of the metal barrier ribs are insulated from the intermediate electrodes; and fluorescent layers formed in the discharge spaces;

wherein the intermediate electrodes and the metal barrier ribs are disposed such that a floating capacity between the intermediate electrodes and the metal barrier ribs is increased to enhance the capacitive coupling of the intermediate electrodes and the metal barrier ribs, and the potential of the intermediate electrodes is stabilized by the potential of the metal barrier ribs.

20. The plasma display panel according to claim 19, further comprising a drive means for driving the first and second display electrodes by an alternate anode drive and cathode drive such that the first or the second display electrodes are driven by the anode drive while the other display electrodes are driven by the cathode drive, and always driving the intermediate electrodes by the anode drive.

21. The plasma display panel according to claim 19, wherein the anode drive is an application of a voltage of 0 V.

22. The plasma display panel according to claim 19, wherein, for each cell, the intermediate electrodes are disposed such that each gap between the intermediate electrodes and the first and second display electrodes are equal.

23. The plasma display panel according to claim 22, wherein projections projecting from each of the first and second display electrodes toward the intermediate electrodes are formed for each of the first and second display electrodes.

24. The plasma display panel according to claim 22, wherein projections projecting from the opposite sides of the intermediate electrodes toward the first and second display electrodes are formed.

25. The plasma display panel according to claim 19, wherein a floating capacity between the intermediate electrodes and the metal barrier ribs is greater than a floating capacity between the display electrodes and the metal barrier ribs.

* * * * *